US011835288B2

(12) United States Patent
Kang

(10) Patent No.: US 11,835,288 B2
(45) Date of Patent: Dec. 5, 2023

(54) AIR CONDITIONER SYSTEM AND METHOD TO CONTROL DEFROSTING USING CAMERA AND SENSOR DATA

(71) Applicant: LG ELECTRONICS INC., Seoul (KR)

(72) Inventor: Kyungwon Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 225 days.

(21) Appl. No.: 17/238,364

(22) Filed: Apr. 23, 2021

(65) Prior Publication Data

US 2021/0333039 A1 Oct. 28, 2021

(30) Foreign Application Priority Data

Apr. 27, 2020 (KR) ..... 10-2020-0050775

(51) Int. Cl.
*F25D 21/00* (2006.01)
*F25B 13/00* (2006.01)
*F25B 49/02* (2006.01)

(52) U.S. Cl.
CPC ..... *F25D 21/006* (2013.01); *F25B 13/00* (2013.01); *F25B 49/02* (2013.01)

(58) Field of Classification Search
CPC ..... F25D 21/006; F25B 13/00; F25B 49/02
See application file for complete search history.

(56) References Cited

U.S. PATENT DOCUMENTS 4,751,825 A * 6/1988 Voorhis ..... F25D 21/006 62/155
2007/0196023 A1* 8/2007 Hama ..... H04N 19/124 375/E7.161

(Continued)

FOREIGN PATENT DOCUMENTS

CN 101929755 12/2010
CN 105222285 1/2016

(Continued)

OTHER PUBLICATIONS

European Search Report dated Sep. 15, 2021 issued in Application No. 21169595.2.

(Continued)

*Primary Examiner* — Henry T Crenshaw
(74) *Attorney, Agent, or Firm* — KED & ASSOCIATES

(57) ABSTRACT

An air conditioner system is provided that may include an air conditioner including a compressor, an outdoor heat exchanger that performs heat exchange using refrigerant discharged from the compressor, a camera module that photographs the outdoor heat exchanger, a sensor unit including a plurality of sensors, and a communication unit that transmits an image of the outdoor heat exchanger photographed by the camera module and sensor data detected by the sensor unit, and a server including a communication unit that receives the image of the outdoor heat exchanger photographed by the camera module and the sensor data detected by the sensor unit, and a defrosting controller that determines whether the outdoor heat exchanger is frosted based on image data of the outdoor heat exchanger photographed by the camera module, and predicts a frosting timing based on the sensor data detected by the sensor unit.

10 Claims, 12 Drawing Sheets

(56) References Cited

U.S. PATENT DOCUMENTS

| | | | | |
|---|---|---|---|---|
| 2011/0094245 | A1* | 4/2011 | Kim | F25D 21/02 62/275 |
| 2013/0042638 | A1* | 2/2013 | Eom | F25D 21/02 62/151 |
| 2016/0259994 | A1* | 9/2016 | Ravindran | G06V 10/82 |
| 2017/0370627 | A1* | 12/2017 | Takenaka | F25B 13/00 |
| 2019/0072320 | A1* | 3/2019 | Devi | F25D 29/008 |

FOREIGN PATENT DOCUMENTS

| | | | |
|---|---|---|---|
| CN | 108800437 | | 11/2018 |
| CN | 109059355 | | 12/2018 |
| CN | 109084443 | | 12/2018 |
| CN | 109469962 | | 3/2019 |
| CN | 110715401 | * | 8/2019 |
| CN | 110715401 | | 1/2020 |
| EP | 2757327 | | 7/2014 |
| KR | 10-2014-0110355 | | 9/2014 |
| KR | 10-2018-0124556 | | 11/2018 |

OTHER PUBLICATIONS

Chinese Office Action dated May 27, 2022 issued in Application No. 202110430774.8 (English translation attached).

* cited by examiner

AIR CONDITIONER SYSTEM AND METHOD TO CONTROL DEFROSTING USING CAMERA AND SENSOR DATA

CROSS-REFERENCE TO RELATED APPLICATION(S)

This application claims priority under 35 U.S.C. § 119 to Korean Application No. 10-2020-0050775 filed on Apr. 27, 2020, whose entire disclosure is hereby incorporated by reference.

BACKGROUND

1. Field

An air conditioner system and a method for operating an air conditioner system are disclosed herein.

2. Background

An air conditioner is installed to provide a more comfortable indoor environment for humans by discharging cold and hot air into a room to adjust an indoor temperature and purify indoor air so as to create a comfortable indoor environment. In general, an air conditioner includes an indoor unit including a heat exchanger and installed indoors, and an outdoor unit including a compressor and a heat exchanger to supply refrigerant to the indoor unit.

The air conditioner is separated into and controlled as an indoor unit including a heat exchanger and an outdoor unit including a compressor and a heat exchanger, and the outdoor unit and the indoor unit are connected by a refrigerant pipe. The refrigerant compressed by the compressor of the outdoor unit is supplied to the heat exchanger of the indoor unit through the refrigerant pipe, and the refrigerant heat-exchanged in the heat exchanger of the indoor unit is introduced again into the compressor of the outdoor unit through the refrigerant pipe. Accordingly, the indoor unit discharges hot and cold air into the room through heat exchange using a refrigerant.

As described above, the refrigerant circulates in the air conditioner, and in the process of heat exchange, the air conditioner discharges cold air or hot air to operate in a cooling mode or a heating mode. When the air conditioner performs a heating operation for a certain period of time or longer, freezing occurs in the outdoor heat exchanger operating as an evaporator. Accordingly, there is a problem in that heating efficiency is reduced. Therefore, the air conditioner often performs a defrosting operation for a certain period of time when a threshold setting condition is satisfied.

For example, when a refrigerant suction superheat degree value reaches a preset or predetermined value, Korean Patent Publication No. 10-2014-0110355, published Sep. 17, 2014 and hereby incorporated by reference, discloses performing a defrosting operation when it is determined that frosting is occurring. In addition, Korean Patent Publication No. 10-2018-0124556, published Nov. 21, 2018 and hereby incorporated by reference, discloses checking whether a shielding rate calculated based on an outdoor heat exchanger temperature measured by an outdoor heat exchanger temperature sensor is higher than a reference value, and performing a defrosting operation.

As described above, simple threshold-based logics of specific values, such as a refrigerant suction superheat degree and shielding rate, often do not accurately detect an actual frosting phenomenon, even if the actual frosting phenomenon occurs when an observation value does not reach the threshold in a threshold boundary area. In addition, as a cycle change gradually occurs after the actual frosting occurs, it is difficult to immediately detect the actual frosting using simple threshold-based logics.

When the defrosting operation is performed, a set operation is not performed indoors. Accordingly, there is a problem in that it causes inconvenience to a user when the defrosting operation is performed too often or performed for a long time.

However, as a conventional air conditioner is set to perform a defrosting operation for a certain period of time when operated for a specified time regardless of a surrounding environment, the defrosting operation may be unnecessarily performed or be performed too late. Accordingly, there is a problem in that operation efficiency is greatly degraded.

BRIEF DESCRIPTION OF THE DRAWINGS

Embodiments will be described in detail with reference to the following drawings in which like reference numerals refer to like elements, and wherein.

DETAILED DESCRIPTION

Figure 1:
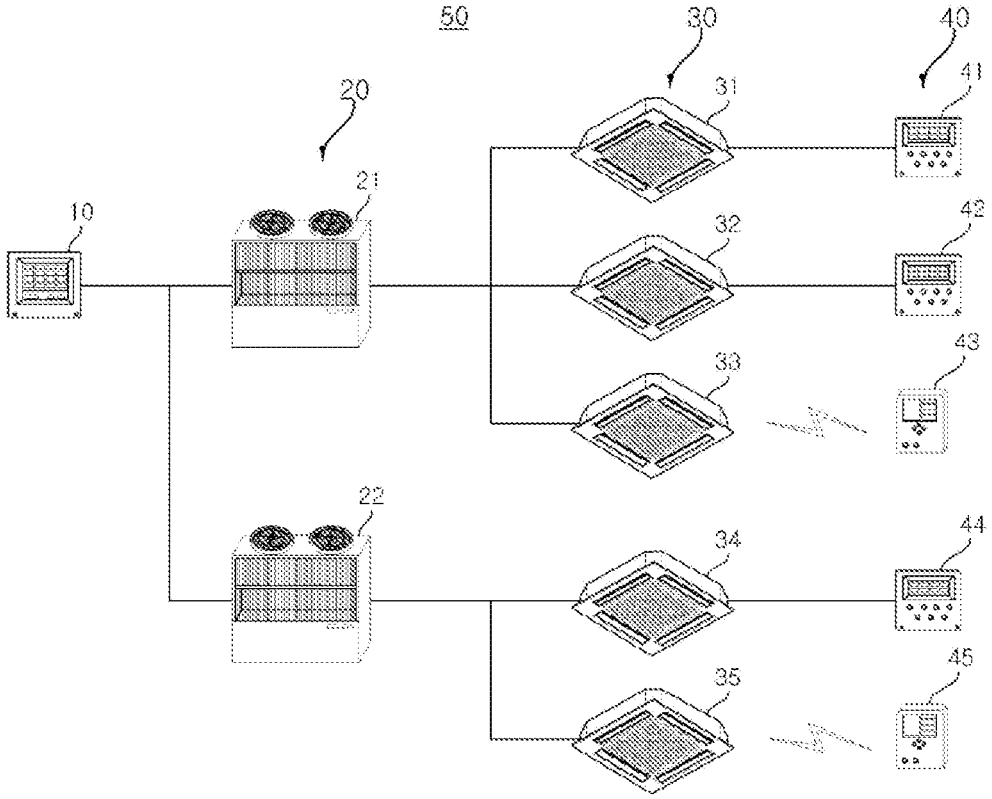
FIG. 1 is a schematic diagram of an air conditioner according to an embodiment.

Hereinafter, embodiments will be described with reference to the accompanying drawings. However, it is obvious that the embodiments are not limited to these embodiments and may be modified in various forms.

In the drawings, in order to clearly and briefly describe embodiments, illustration of components irrelevant to the description have been omitted, and the same reference numerals are used for identical or extremely similar components throughout the specification.

Meanwhile, the suffixes "module" and "unit" for the constituent elements used in the following description are given only in consideration of ease in preparation of the specification, and do not impart a particularly important meaning or role by themselves. Accordingly, the "module" and "unit" may be used interchangeably with each other.

In addition, in the present specification, terms such as first and second may be used to describe various elements, but these elements are not limited by these terms. These terms are only used to distinguish one element from another.

An air conditioner system according to an embodiment may include one or more air conditioners. In addition, the air conditioner system according to an embodiment may include other apparatuses, such as a server, in addition to the air conditioner. In this case, the apparatuses included in the air conditioner system may have a communication module to communicate with other devices via wire/wireless communication and perform an associated operation.

FIG. 1 is a schematic diagram of an air conditioner according to an embodiment. Referring to FIG. 1, an air conditioner (air conditioner system) 50 according to an embodiment may include a plurality of units. For example, the air conditioner 50 according to an embodiment may include an indoor unit 30 and an outdoor unit 20. In addition, the air conditioner 50 according to an embodiment may further include a remote controller 40 connected to the indoor unit 30 and a central controller 10 capable of controlling units inside of the air conditioner 50.

The air conditioner 50 according to an embodiment may include indoor units 31 to 35, outdoor units 21 and 22 connected to the indoor units 31 to 35, and remote controllers 41 to 45 connected to the indoor units 31 to 35 respectively. In addition, the air conditioner 50 according to an embodiment may further include the central controller 10 that controls a plurality of indoor units 31 to 35 and outdoor units 21 and 22.

The central controller 10 may be connected to the plurality of indoor units 31 to 36 and the plurality of outdoor units 21 and 22 to monitor and control operations of the indoor units and outdoor units. In this case, the central controller 10 may be connected to a plurality of indoor units to perform operation setting, lock setting, schedule control, and group control, for example, for the indoor unit.

As the air conditioner, any of a stand type air conditioner, a wall-mounted type air conditioner, and a ceiling type air conditioner may be employed, but for convenience of explanation, a ceiling type air conditioner is described by way of illustration. In addition, the air conditioner may further include at least one of a ventilation device, an air purifier, a humidifier, and/or a heater, for example, and may operate in conjunction with the operation of the indoor unit and the outdoor unit.

The outdoor unit 21, 22 may include a compressor (not shown) that receives and compresses refrigerant, an outdoor heat exchanger (not shown) that exchanges heat with the refrigerant and outdoor air, an accumulator (not shown) that extracts gaseous refrigerant from the supplied refrigerant and supplies the extracted refrigerant to the compressor, and a four-way valve (not shown) that selects a flow path of the refrigerant according to the heating operation. In addition, the outdoor unit 21, 22 may further include a plurality of sensors, a valve, and an oil recovery device, for example. The outdoor unit 21, 22 may operate the provided compressor and outdoor heat exchanger to compress or heat exchange the refrigerant according to a setting and supply the refrigerant to the indoor unit 31, 35.

The outdoor unit 21, 22 may be driven by a request of the central controller 10 or the indoor unit 31, 35, and as the cooling/heating capacity varies in correspondence with the driven indoor unit, the number of operations of the outdoor unit and the number of operations of the compressor installed in the outdoor unit are varied.

It is illustrated that the plurality of outdoor units 21 and 22 supply refrigerant to each connected indoor unit; however, a plurality of outdoor units may be interconnected according to a connection structure of the outdoor unit and the indoor unit and supply refrigerant to the plurality of indoor units. The indoor unit 31, 35 may be connected to any one of the plurality of outdoor units 21 and 22 to receive refrigerant and discharge hot and cold air into a room. The indoor unit 31 to 35 may include an indoor heat exchanger (not shown), an indoor unit fan (not shown), an expansion valve (not shown) through which the supplied refrigerant is expanded, and a plurality of sensors (not shown).

The outdoor unit 21, 22 and the indoor unit 31 to 35 may be connected through a communication line to transmit and receive data. The outdoor unit and the indoor unit may be connected to the central controller 10 by a separate communication line to operate according to the control of the central controller 10.

The remote controller 41 to 45 may be connected to each indoor unit, input a user's control command to the indoor unit, and receive and display state information of the indoor unit. In this case, the remote controller may communicate by wire or wirelessly according to a connection type with the indoor unit, and in some cases, a single remote controller may be connected to the plurality of indoor units, and settings of the plurality of indoor units may be changed through a single remote control input. According to an embodiment, the remote controller 41 to 45 may include various sensors such as a temperature sensor therein.

Figure 2:
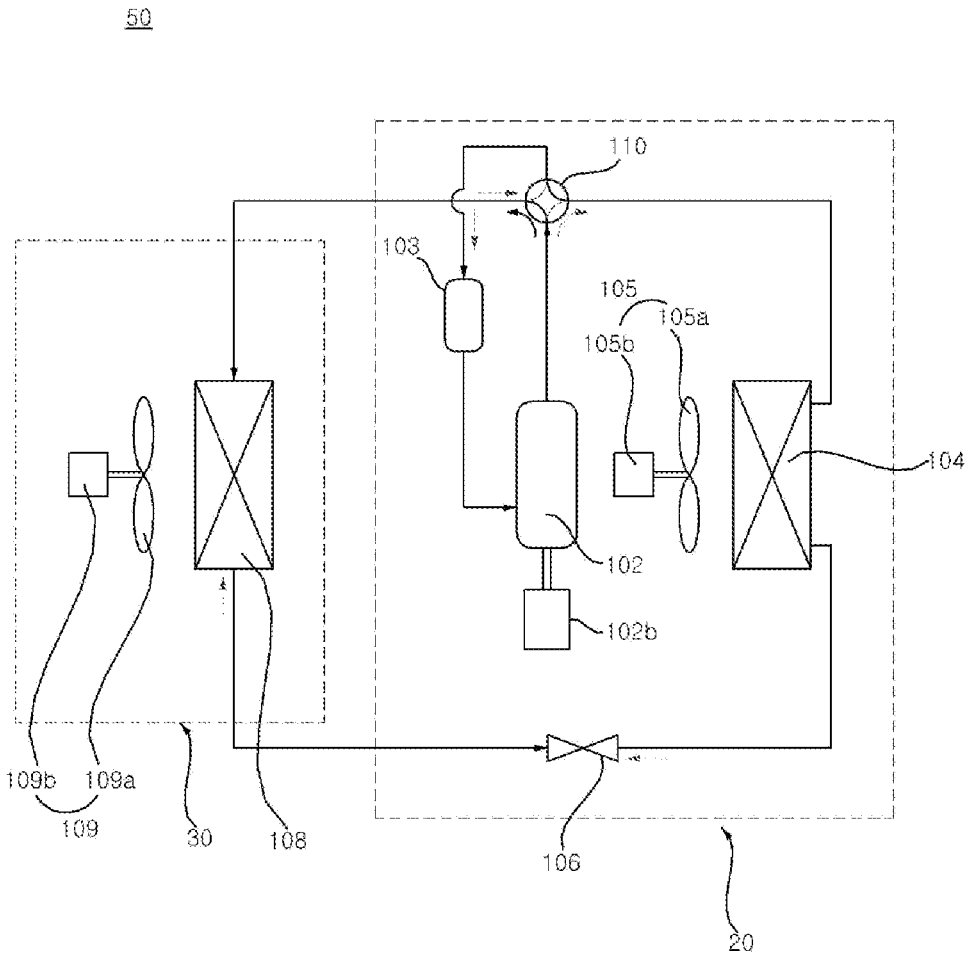
FIG. 2 is a schematic diagram of an outdoor unit and an indoor unit of FIG. 1.

FIG. 2 is a schematic diagram of an outdoor unit and an indoor unit of FIG. 1. Referring to FIG. 2, the air conditioner 50 may be divided into indoor unit 30 and outdoor unit 20.

The indoor unit 30 may include an indoor heat exchanger 108 that is disposed indoors and performs a cooling/heating function, an indoor blower 109 including an indoor fan 109*a* that is disposed at one side of the indoor heat exchanger 108 and promotes heat dissipation of refrigerant, and an electric motor 109*b* that rotates the indoor fan 109*a*, for example. At least one indoor heat exchanger 108 may be provided. At least one of an inverter compressor and a constant speed compressor may be used as the compressor 102.

The air conditioner 50 may be configured as a cooler that cools the room, or may be configured as a heat pump that cools or heats the room. The outdoor unit 20 may include a compressor 102 that serves to compress a refrigerant, a compressor motor 102*b* that drives the compressor 102, an outdoor heat exchanger 104 that serves to dissipate the compressed refrigerant, an outdoor blower 105 including an outdoor fan 105*a* that is disposed at one side of the outdoor heat exchanger 104 and promotes heat dissipation of the refrigerant and an electric motor 105*b* that rotates the outdoor fan 105*a*, an expansion mechanism 106 that expands a condensed refrigerant, a cooling/heating switching valve 110 that changes the flow path of the compressed refrigerant, an accumulator 103 that temporarily stores the gasified refrigerant to remove moisture and foreign substances, and then supplies refrigerant having a constant pressure to the compressor, for example.

FIG. 2 illustrates a single indoor unit 30 and a single outdoor unit 20; however, the air conditioner according to an embodiment is not limited thereto, and it is obvious that it can be applied to a multi-type air conditioner including a plurality of indoor units and outdoor units, or an air conditioner having a single indoor unit and a plurality of outdoor units, for example.

Figure 3:
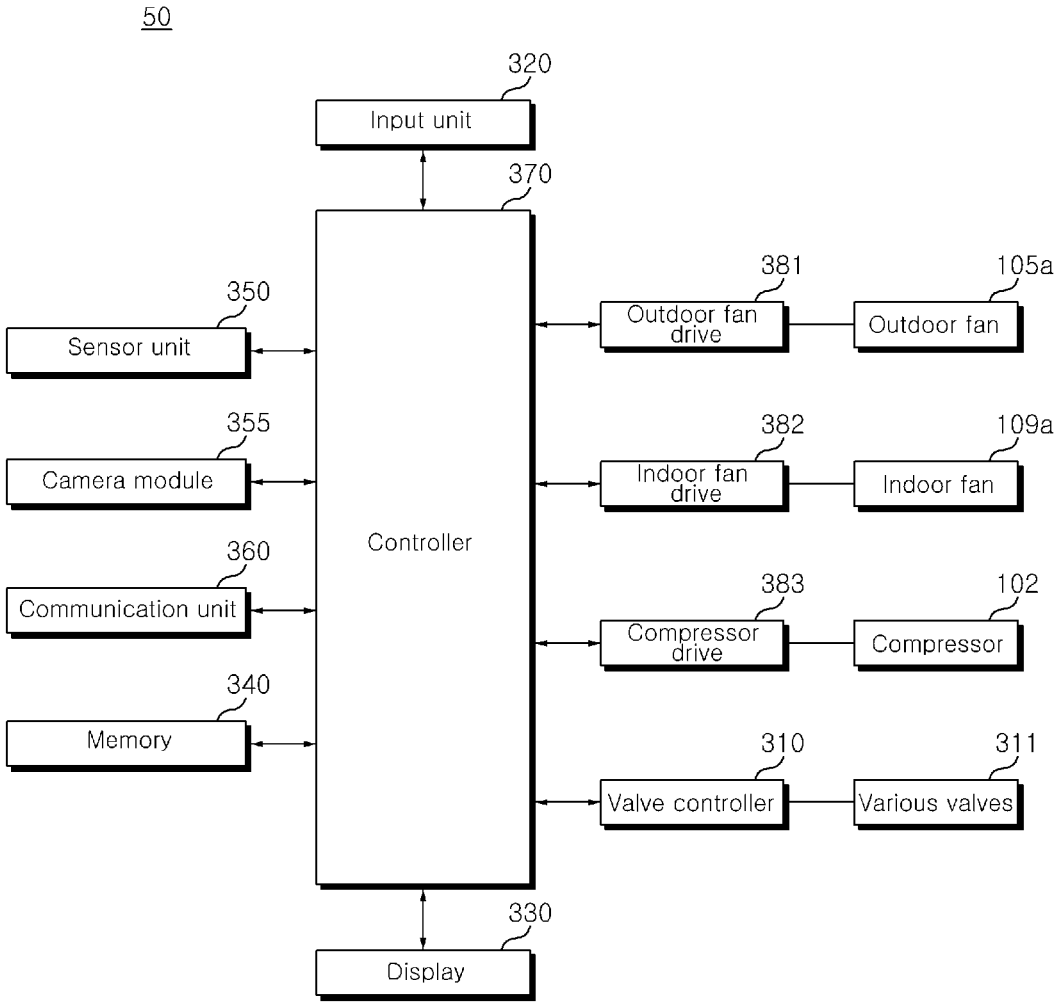
FIG. 3 is a simplified internal block diagram of the air conditioner of FIG. 1.

FIG. 3 is a simplified internal block diagram of the air conditioner of FIG. 1. Referring to FIG. 3, the air conditioner 50 may include compressor 102, outdoor fan 105*a*, indoor fan 109*a*, a controller 370, a sensor unit 350, a camera module 355, a communication unit 360, and a memory 340. In addition, the air conditioner 50 may further include a compressor drive 383, an outdoor fan drive 381, an indoor fan drive 382, various valves 311, such as a switching valve and an expansion valve, a display 330, and an input unit 320, for example. The compressor 102, the outdoor fan 105*a*, and the indoor fan 109*a*, for example, may operate as described above with reference to FIGS. 1 and 2.

The input unit 320 may be provided with a plurality of operation buttons, and transmit a signal for an input operating target temperature of the air conditioner to the controller 370.

The display 330 may display an operating state of the air conditioner 50. For example, the display 330 may include a display means for outputting an operating state of the indoor unit 20, and display an operating state and an error.

The display 330 may display a wiring status between the indoor unit 20 and the outdoor unit 30. For example, the display 330 may include a light emitting diode (LED), and the LED may be turned on when the wiring status of a communication line and/or a power line is normal, and may be turned off when the wiring status of the communication line and/or the power line is abnormal.

The sensor unit 350 may include a plurality of sensors to obtain data related to the operation and state of the air conditioner 50. The sensor unit 350 may be provided with various sensors to obtain cycle operation data.

For example, the sensor unit 350 may include a plurality of temperature sensors. A discharge temperature sensor unit may detect a refrigerant discharge temperature from the compressor 102 and transmit a signal for the detected refrigerant discharge temperature to the controller 370. An outdoor temperature sensor may detect an outdoor temperature, which is a temperature around the outdoor unit 30 of the air conditioner 50, and may transmit a signal for the detected outdoor temperature to the controller 370. An indoor temperature sensor may detect an indoor temperature, which is the temperature around the indoor unit 20 of the air conditioner 50, and may transmit a signal for the detected indoor temperature to the controller 370.

The controller 370 may control operation of the air conditioner 50, based on the input target temperature, and at least one of the detected refrigerant discharge temperature, the detected outdoor temperature, or the detected indoor temperature. For example, the controller 370 may control the air conditioner 50 to operate, by calculating a final target superheat degree.

In addition, the sensor unit 350 may include a humidity sensor, a pressure sensor, and other sensors capable of acquiring data related to the operation and state of the air conditioner 50, and may transmit sensor data of the sensors to the controller 370. The controller 370 may control the air conditioner 50 based on sensor data detected by the sensor unit 350.

For controlling operation of the compressor 102, the indoor fan 109*a*, and the outdoor fan 105*a*, as shown in the drawing, the controller 370 may control the compressor drive 383, the outdoor fan drive 381, the indoor fan drive 382, and valve controller 310, respectively. For example, the controller 370 may output a corresponding speed command value signal to the compressor drive 383, the outdoor fan drive 381, or the indoor fan drive 382, respectively, based on a target temperature. Further, based on each speed command value signal, the compressor motor 102*b*, the outdoor fan motor 105*b*, and the indoor fan motor 109*b* may be operated at a target rotational speed, respectively.

The controller 370 may control an overall operation of the air conditioner 50, in addition to controlling the compressor drive 383, the outdoor fan drive 381, or the indoor fan drive 382. For example, the controller 370 may control an operation of the cooling/heating switching valve or four-way valve 110 through the valve controller 310. Alternatively, the controller 370 may control an operation of the expansion mechanism or the expansion valve 106 through the valve controller 310. The air conditioner may further include a power supply (not shown) that supplies power to each unit, such as the compressor 102, the outdoor fan 105*a*, the indoor fan 109*a*, the controller 370, and the memory 340.

The camera module 355 may include a digital camera. The digital camera may include at least one optical lens, an image sensor, for example, a CMOS image sensor, configured to include a plurality of photodiodes, for example, pixels, forming an image by light passed through the optical lens, and a digital signal processor (DSP) that forms an image based on signals output from the photodiodes. The digital signal processor is capable of generating not only a still image but also a moving image having frames composed of still images.

The camera module 355 may obtain image data of the outdoor heat exchanger 104 by photographing the outdoor heat exchanger 104. The image data of the outdoor heat exchanger 104 photographed by the camera module 355 may be transmitted to other devices, such as the controller 370 and/or a server.

The memory 340 may store data necessary for operation and control of the air conditioner 50. In addition, the memory 340 may store image data obtained through the camera module 355 and sensor data obtained through the sensor unit 350.

The communication unit 360 may include one or more communication modules to transmit/receive with other devices by wire or wirelessly. The controller 370 may transmit state information of the air conditioner 50 to other devices, such as a server (not shown), through the communication unit 360. For example, the controller 370 may control the communication unit 360 so that image data obtained through the camera module 355 and sensor data obtained through the sensor unit 350 are transmitted to other devices, such as a server. In addition, the controller 370 may control the air conditioner 50 based on a control signal and various data received from other devices, such as a server.

According to an embodiment, the air conditioner 50 may further include defrosting controller 600 described hereinafter with reference to FIG. 6 for example. Alternatively, the air conditioner 50 may further include at least defrosting control unit 670. In this case, the defrosting control unit 670 may be implemented as a partial block of the controller 370 or as a separate block from the controller 370.

Accordingly, the air conditioner 50 may determine whether the outdoor heat exchanger is frosted based on the image data of the outdoor heat exchanger photographed by the camera module 355, and may predict the timing of frosting based on the sensor data detected in the sensor unit 350.

According to one embodiment, the air conditioner 50 may communicate with a server including the defrosting controller 600 or at least the defrosting control unit 670 and perform a defrosting operation and a frost prevention control operation.

Figure 4:
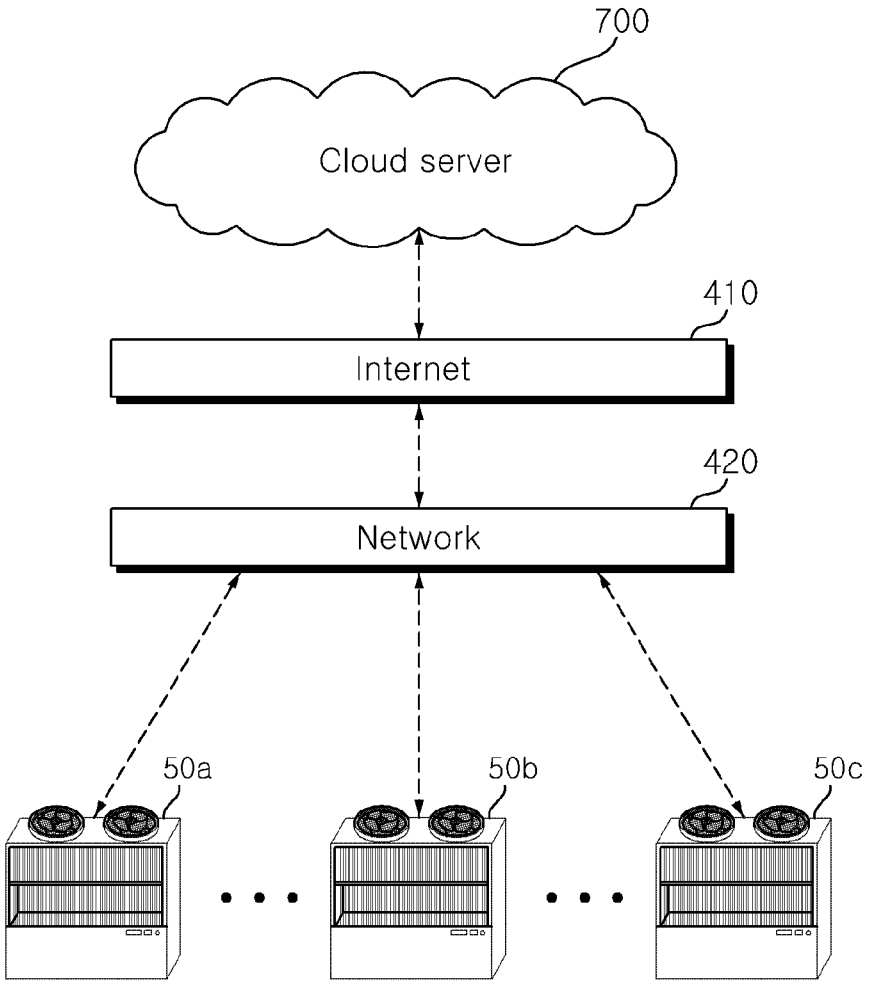
FIGS. 4 and 5 are schematic diagrams of an air conditioner system according to an embodiment.
Figure 5:
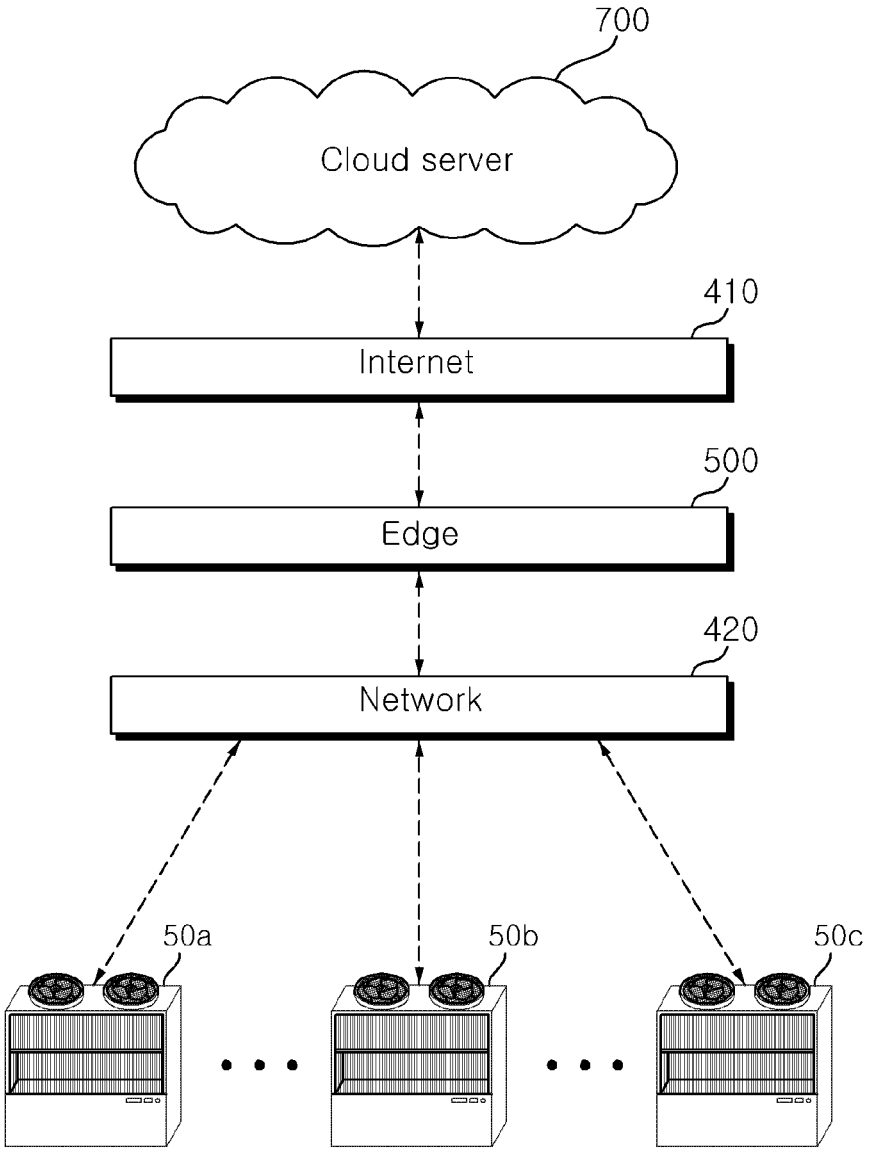

FIGS. 4 and 5 are schematic diagrams of an air conditioner system according to an embodiment. Referring to FIG. 4, an air conditioner system according to an embodiment may include one or more air conditioners 50*a*, 50*b*, 50*c* and server 700.

The one or more air conditioner 50*a*, 50*b*, 50*c* may access Internet 410 through a network 420, such as a gateway, and may transmit and receive data with the server 700. For example, the one or more air conditioner 50*a*, 50*b*, and 50*c* may transmit image data obtained through the camera module 355 and sensor data obtained through the sensor unit 350 to the server 700, and may perform a defrosting operation and a frost prevention control operation based on data received from the server 700.

The server 700 may be a server operated by a manufacturer of the one or more air conditioner 50*a*, 50*b*, 50*c* or a company entrusted with a service by the manufacturer, or may be a kind of cloud server. The server 700 may include defrosting controller 600, which will be described hereinafter with reference to FIG. 6, for example. Alternatively, the server 700 may include at least defrosting control unit 670. Accordingly, the server 700 may determine whether the outdoor heat exchanger is frosted based on the image data of the outdoor heat exchanger photographed by the camera module 355, and may predict the timing of frosting based on the sensor data detected by the sensor unit 350.

Referring to FIG. 5, in order to overcome limitations of data processing speed and capacity, the air conditioner system according to an embodiment may further include an edge 500. If the server 700 determines whether frosting has occurred, predicts the start timing of frosting, and performs defrosting control and frost prevention control, while continuously processing the sensor data of the one or more air conditioner 50*a*, 50*b*, 50*c*, an increase in data load and a decrease in processing speed may occur. Accordingly, the edge 500 may perform pre-processing of data for determining whether frosting has occurred and predicting the start timing of frosting. For example, the edge 500 may convert the pixel size and gray scale of the image data of the outdoor heat exchanger received from the one or more air conditioner 50*a*, 50*b*, 50*c*, remove noise from the sensor data received from the one or more air conditioner 50*a*, 50*b*, 50*c*, and then, transmit to the server 700.

FIGS. 4 and 5 illustrate that there is a single server 700. However, embodiments are not limited thereto. For example, the system according to embodiments disclosed herein may operate in conjunction with two or more servers.

Figure 6:
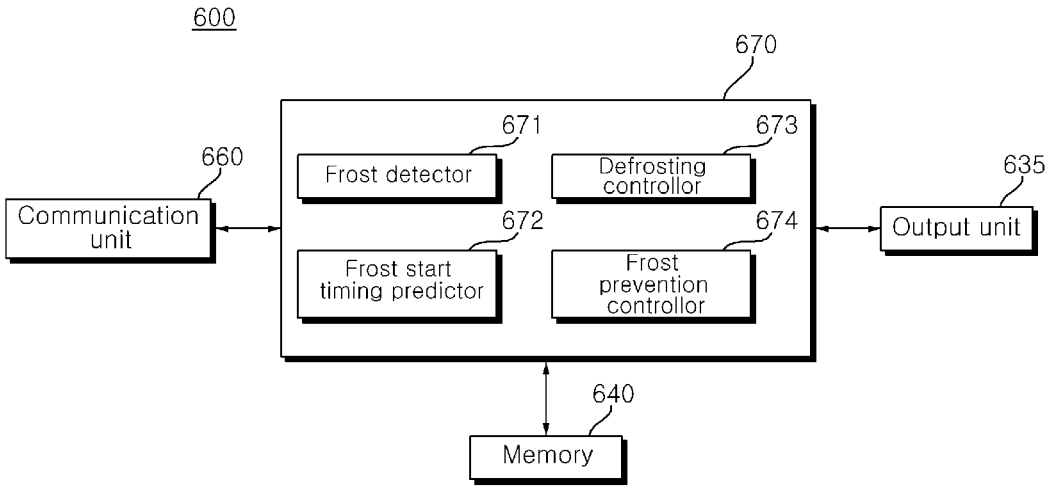
FIG. 6 is a simplified internal block diagram of a defrosting controller according to an embodiment.

FIG. 6 is a simplified internal block diagram of a defrosting controller according to an embodiment. Referring to FIG. 6, the defrosting controller 600 according to an embodiment may include defrosting control unit 670 that determines whether the outdoor heat exchanger 104 is frosted based on the image data of the outdoor heat exchanger 104, and predicts the frosting timing based on the sensor data detected in the sensor unit 350.

In addition, the defrosting controller 600 according to an embodiment may be configured as an independent modular device, and may be mounted inside of the server 700 or the air conditioner 50 or connected by wired or wirelessly to be used. In this case, the defrosting controller 600 may further include a communication unit 660.

In addition, the defrosting controller 600 may further include a memory 640 that stores data. The memory 640 may store data received from the server 700 or the air conditioner 50, data obtained by processing or analyzing the received data, data necessary for operation of the defrosting controller 600, and/or data related to various error codes, for example.

According to one embodiment, the defrosting controller 600 may further include its own output unit 635. For example, the output unit 635 may have a seven-segment display and output a code corresponding to a current state or a recognition result. Alternatively, the output unit 635 may be provided with a visual output means more than a seven-segment display or an audio output means.

The defrosting controller 600 may receive image data and sensor data of the outdoor heat exchanger through the communication unit 660, and may determine, through the defrosting control unit 670, whether the outdoor heat exchanger 104 is in a frosted state or a normal state based on the received data, and predict the time when frosting occurs.

The defrosting control unit 670 may use a machine learning model that performs two different roles. It is possible to determine whether the air conditioner is frosted using a machine learning model that discerns current frosting of air conditioner, and it is possible to predict the next frosting occurrence time using a machine learning model that predicts the time when frosting will occur, thereby minimizing a defrosting operation time and preventing degradation of heating performance caused by the defrosting operation.

The defrosting control unit 670 may include a frost detector 671 that classifies image data of the outdoor heat exchanger 104 into image data of frosted and normal states using a Convolutional Neural Network (CNN)-based image classification model, and a frosting start timing predictor 672 that predicts the remaining time until frosting using one or more machine learning models when the cycle operation data of the air conditioner 50 is input.

The frost detector 671 may serve to diagnose a current state of the air conditioner 50 by performing a task of classifying image data in frosted and normal states using a CNN-based image classification model, and may enable start of defrosting control when determining frosting, by adding determination of frosting to the start condition of defrosting control logic.

When receiving cycle operation data obtained from the sensor unit 350 in real time, the frosting start timing predictor 672 predicts a corresponding frosting timing and predicts the remaining time until frosting using one or more machine learning models of Random Forest, Deep Neural Network (DNN), and CNN.

The defrosting control unit 670 may further include a defrosting controller 673 that controls the air conditioner 50 to perform the defrosting operation when the frost detector 671 determines the frosted state, and a frost prevention controller 674 that controls the air conditioner 50 to perform a frost prevention operation, when the remaining time until the frosting predicted by the frosting start timing predictor is less than or equal to a threshold value. Control signals output from the defrosting controller 673 and the frost prevention controller 674 may be transmitted to the communication unit 360 of the air conditioner 50 through the communication unit 660. Alternatively, the control signal output from the defrosting controller 673 and the frost prevention controller 674 may be transmitted to the server 700, and the server 700 may transmit the control signal output from the defrosting controller 673 and the frost prevention controller 674 to the air conditioner 50.

The control signal output from the defrosting controller 673 and the frost prevention controller 674 may be transmitted to the controller 370 of the air conditioner 50, and the air conditioner 50 may perform the defrosting operation and the frost prevention operation based on the received control signal.

The defrosting operation may be performed when the air conditioner 50 is in a heating operation and is in a frosted state, and is to perform a cooling operation for a certain time by switching the heating operation to the cooling operation.

The defrosting operation may be performed until the frost detector 671 determines that the state of the outdoor heat exchanger 104 is a normal state.

The frost prevention operation drives the compressor 102 at an operation frequency lower than a compressor operation frequency in a normal state, thereby preventing the occurrence of a frosted state by operating the compressor 102 at an operation frequency lower than usual. The defrosting controller 673 starts the defrosting operation when the frost detector 671 determines that frosting has occurred, and operates to switch from the heating operation to the cooling operation. The defrosting controller cancel condition continues until the frost detector 671 determines that it is in a normal state.

The frost prevention controller 674 operates when the remaining time until the frosting starting predicted by the frosting start timing predictor 672 is within a threshold value, and starts the frost prevention operation. The frost prevention operation is canceled when the defrosting operation starts or when the remaining time until the frosting starting is equal to or more than a set threshold value.

In the case of general multiple defrosting operation logics, in order to determine whether frosting has occurred in the heat exchanger, a rule-based determination logic is implemented and determined by capturing a physical phenomenon in the heating cycle that changes after the frosting occurs. Accordingly, the general defrosting operation logic has a problem in that the defrosting logic operates after the heat exchange efficiency has already deteriorated considerably as the defrosting operation starts after a considerable period of time has elapsed after the actual frosting occurs, and has a disadvantage in that it takes a long time to reach a normal state by the defrosting operation as the frosting has already progressed considerably.

According to one embodiment, a defrosting operation time may be minimized by determining whether the air conditioner 50 is frosted/normal and predicting the frosting start timing using separate machine learning models, and degradation of heating performance due to the defrosting operation may be prevented.

According to one embodiment, when frosting occurs in the heat exchanger 104 through direct observation of an image obtained using the camera module 355, it is possible to quickly determine the frosting. That is, the artificial neural network may determine whether the frosting has occurred through an image with the same logic and accuracy as the human eye checking that the frosting has occurred in the heat exchanger 104.

In embodiments disclosed herein, it is possible to quickly and accurately determine frosting in comparison with the conventional technology by applying the frosting diagnosis technology through direct observation, away from a conventional technology that estimated the frosting based on the change in cycle factors. In addition, according to embodiments disclosed herein, a more stable operation of the air conditioner may be achieved by reducing the number of occurrences of frosting by predicting the timing of frosting starting and using the result in controlling the air conditioner.

Unlike conventional technology that determines simply whether frosting has occurred and starts a defrosting operation, embodiments disclosed herein additionally introduce technology that predicts the next frosting start time, thereby reducing the number of times a defrosting operation must be started and frosting of the heat exchanger and increases efficiency of a heating operation to reduce customer dissatisfaction due to a defrosting operation and improves product quality.

According to embodiments disclosed herein, the defrosting control unit 670 may further include a data receiving unit (not shown) that converts the pixel size and gray scale of the image data of the outdoor heat exchanger 102 and removes noise of the sensor data. The data receiving unit is a device that collects image data in frosted and normal states collected from the camera module 355 attached to the heat exchanger 104 of the outdoor unit 30, and operation data received from the temperature sensor, the humidity sensor, and the pressure sensor installed throughout the air conditioner 50 such as a evaporator, a condenser, and compressor 102, and may perform pre-processing tasks, such as a noise removal of a sensor signal, pixel size adjustment, and gray scale conversion through a filter application.

According to embodiments disclosed herein, the defrosting control unit 670 may further include an error code output unit (not shown) that generates an error code corresponding to the execution of the defrosting operation or the frost prevention operation. The generated error code may be stored in the memory 640.

The error code output unit may generate and store an error code in the internal memory 640 when the defrosting controller 673 starts the defrosting operation or when the frost prevention controller 674 starts the frost prevention operation. In addition, according to an embodiment, the error code output unit may output a corresponding error code to the display of a main printed circuit board (PCB) or the display of the control panel, and the error code display may also be canceled when the defrosting operation or the frost prevention operation is canceled.

According to an embodiment, the air conditioner 50 may include at least some components of the defrosting controller 600. For example, the defrosting controller 600 may be mounted inside of the air conditioner 50 or connected by wire or wirelessly to be used. Alternatively, the air conditioner 50 may include the above mentioned defrosting control unit 670.

According to an embodiment, the defrosting control unit 670 may be implemented as a partial block of the controller 370. That is, the air conditioner system according to an embodiment may include compressor 102, outdoor heat exchanger 104 that performs heat exchange using refrigerant discharged from the compressor 102, camera module 355 that photographs the outdoor heat exchanger 104, sensor unit 350 having a plurality of sensors, and controller 370 that performs a defrosting operation by determining whether the outdoor heat exchanger 104 is frosted based on the image of the outdoor heat exchanger 104 photographed by the camera module 355, and predicts the frosting time based on sensor data detected by the sensor unit 350.

According to an embodiment, the air conditioner 50 may further include defrosting control unit 670 separate from the controller 370. That is, the air conditioner system according to an embodiment may include compressor 102, outdoor heat exchanger 104 that performs heat exchange using refrigerant discharged from the compressor 102, camera module 355 that photographs the outdoor heat exchanger 104, sensor unit 350 having a plurality of sensors, and defrosting control unit 670 that performs a defrosting operation by determining whether the outdoor heat exchanger 104 is frosted based on the image of the outdoor heat exchanger 104 photographed by the camera module 355, and predicts the frosting timing based on sensor data detected by the sensor unit 350.

When the air conditioner 50 includes the defrosting control unit 670, the memory 340 of the air conditioner 50 may perform the role of the memory 640 of the defrosting controller 600. In addition, the role of the output unit 635 of the defrosting controller 600 may be performed by the display 330 of the air conditioner 50, for example. For example, when the defrosting operation or the frost prevention operation is performed, the display 330 may display a corresponding error code, and the memory 640 may store the error code.

According to an embodiment, as described with reference to FIGS. 4 and 5, the server 700 may include at least some components of the defrosting controller 600. For example, the defrosting controller 600 may be mounted inside of the server 700 or connected by wire or wirelessly to be used.

Alternatively, the air conditioner 50 may include the above mentioned defrosting control unit 670. That is, the air conditioner system according to an embodiment may include compressor 102, outdoor heat exchanger 104 that performs heat exchange using refrigerant discharged from the compressor 102, camera module 355 that photographs the outdoor heat exchanger 104, sensor unit 350 having a plurality of sensors, and air conditioner 50 including a communication unit that transmits the image of the outdoor heat exchanger 104 photographed by the camera module 355 and sensor data detected by the sensor unit 350 to the server 700, and a communication unit (see 720 in FIG. 7) that includes at least one communication module to receive an image of the outdoor heat exchanger 104 photographed by the camera module 355 and sensor data detected by the sensor unit 350, and server 700 including the defrosting control unit 670 described above with reference to FIG. 6.

Figure 7:
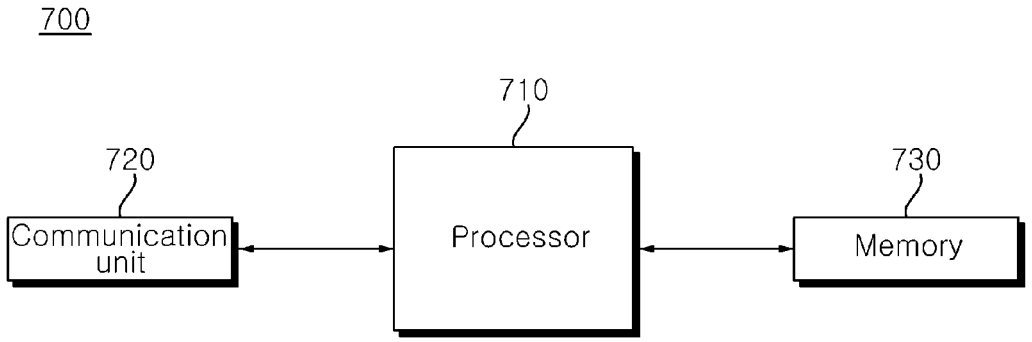
FIG. 7 is a simplified internal block diagram of an air conditioner system server according to an embodiment.

Referring to FIG. 7, the server 700 may include a communication unit 720, a processor 710, and a memory 730. The processor 710 may control an overall operation of the server 700.

According to an embodiment, the processor 710 may be equipped with artificial neural networks (ANN) previously learned by machine learning to perform frosting recognition, for example. For example, the processor 710 may include a deep neural network (DNN), such as a convolutional neural network (CNN), a recurrent neural network (RNN), and a deep belief network (DBN) learned by deep learning. In this case, the defrosting control unit 670 may be implemented as a partial block of the processor 710. The artificial neural network (ANN) may be implemented in the form of software or may be implemented in the form of hardware, such as a chip.

The server 700 may be a server operated by a manufacturer of the air conditioner 50 or a server operated by a service provider, or may be a kind of cloud server.

The communication unit 720 may receive various data, such as state information, operation information, and operation information, for example, from the air conditioner 50, a gateway, or other electronic device, for example. In addition, the communication unit 720 may transmit data corresponding to various received information to the air conditioner 50, a gateway, or other electronic device, for example. The communication unit 720 may include one or more communication modules, such as an Internet module and a mobile communication module.

The memory 730 may store received information, and may have data for generating result information corresponding to the received information. In addition, the memory 730 may store data and result data used for machine learning.

The memory 730 may store data necessary for the operation of the server 700. For example, the memory 730 may store a learning algorithm to be performed by the server 700. The learning algorithm at this time may be a learning algorithm based on a deep neural network as shown in FIGS. 8 and 9.

Figure 8:
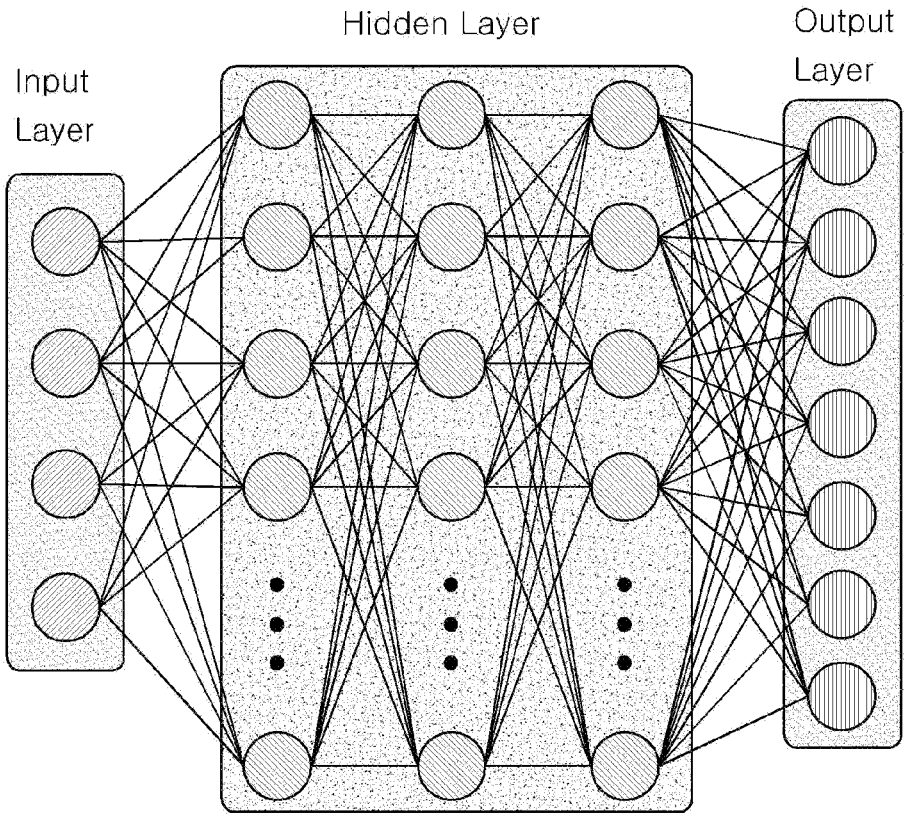
FIGS. 8 and 9 are diagrams referred to for explaining deep learning.
Figure 9:
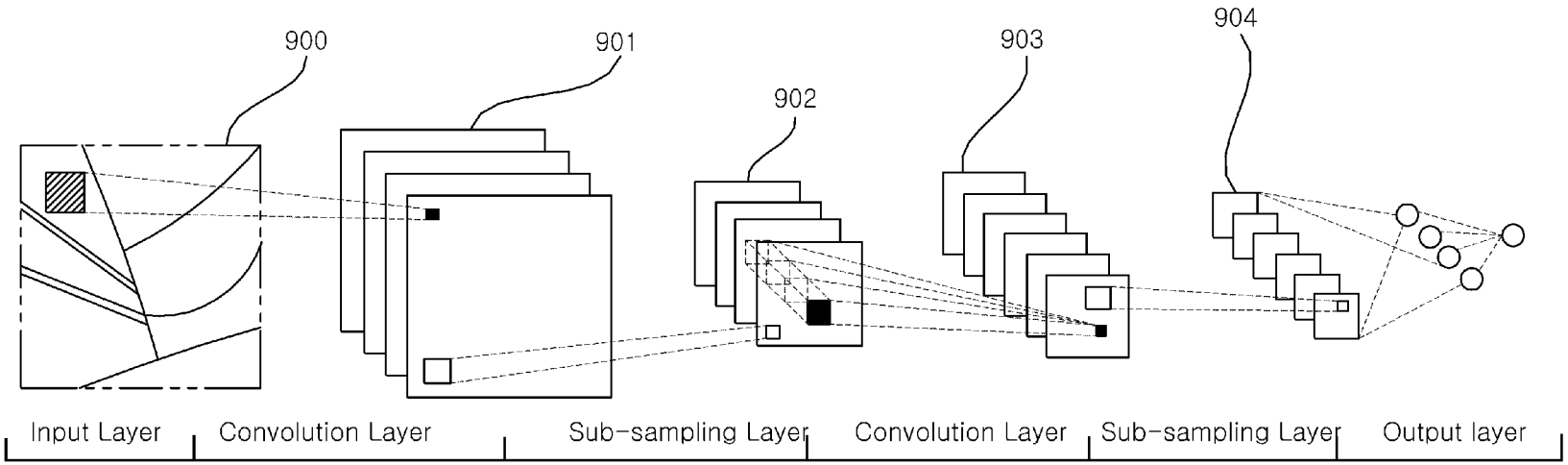

FIGS. 8 and 9 are diagrams referred to for explaining deep learning. Referring to FIG. 8, the processor 710 may perform learning by descending to a deep level in multiple stages based on data in a deep learning technology which is a kind of machine learning.

Deep learning may represent a set of machine learning algorithms that extract core data from a plurality of data while passing through hidden layers consecutively. The deep learning structure may be composed of a deep neural network (DNN), such as CNN, RNN, and DBN.

The deep neural network (DNN) may include an input layer, a hidden layer, and an output layer. A configuration having multiple hidden layers may be referred to as a deep neural network (DNN).

Each layer includes a plurality of nodes, and each layer is related with the next layer. Nodes may be connected to each other with a weight.

An output from an arbitrary node belonging to a first hidden layer 1 becomes an input of at least one node belonging to a second hidden layer. In this case, the input of each node may be a value obtained by applying a weight to the output of the node of the previous layer. Weight may mean the strength of a connection between nodes. The deep learning process may be considered as a process of finding an appropriate weight.

The learning of artificial neural network may be accomplished by adjusting the weight of a connection line between nodes (if necessary, adjusting a bias value) so that a desired output is produced for a given input. In addition, the artificial neural network may continuously update the weight value by learning.

FIG. 9 is a diagram illustrating a structure of a convolutional neural network (CNN) excellent for image processing. CNN is a model that simulates human brain function, based on the assumption that when a person recognizes an object, he/she extracts basic features of the object, then performs complex calculations in the brain and recognizes the object based on the calculation result.

The CNN may also include an input layer, a hidden layer, and an output layer. A certain image 900 is input to the input layer.

Referring to FIG. 9, a hidden layer is composed of a plurality of layers, and may include a convolution layer and a sub-sampling layer. Basically, in CNN, various filters for extracting features of an image through a convolution operation and a pooling or non-linear activation function for adding nonlinear features are used together.

Convolution is mainly used for filter calculation in the field of image processing, and is used to implement a filter for extracting features from an image. For example, if the convolution operation is repeatedly performed for the entire image while moving the 3×3 window, an appropriate result can be obtained according to the weight value of the window.

The convolution layer may be used to perform convolution filtering for filtering information extracted from a previous layer using a filter having a preset size. The convolution layer performs a convolution operation on the input image data 900, 902 using a convolution filter, and generates a feature map 901, 903 in which the feature of the input image 900 is expressed.

As a result of convolutional filtering, filtered images as many as the number of filters may be generated according to the number of filters included in the convolution layer. The convolution layer may be composed of nodes included in filtered images. In addition, the sub-sampling layer paired with the convolution layer may include the same number of feature maps as the paired convolution layer.

The sub-sampling layer reduces the dimension of the feature map 901, 903 through sampling or pooling. The output layer recognizes the input image 900 by combining various features expressed in the feature map 904.

Frosting detection and frosting start time prediction according to embodiments disclosed herein may use various deep learning structures described above. For example, it is possible to determine whether the outdoor heat exchanger 104 is frosted using a convolutional neural network (CNN) structure that is widely used in object recognition in an image.

When the server 700 includes the defrosting control unit 670, the memory 730 of the server 700 may perform the role of the memory 640 of the defrosting controller 600. In addition, the role of the communication unit 610 of the defrosting controller 600 may be performed by the communication unit 720 of the server 700, for example.

The air conditioner system according to an embodiment may use a machine learning model of the frost detector 671 and a machine learning model of the frosting start timing predictor 672 that have different purposes, respectively.

The machine learning model of the frost detector 671 may be used to determine whether the outdoor heat exchanger 104 is frosted or normal, and the machine learning model of the frosting start timing predictor 672 may be used to predict the frosting start timing, thereby minimizing the defrosting operation time, and preventing degradation of heating performance due to the defrosting operation.

The air conditioner system according to an embodiment may include at least a portion, for example, the defrosting control unit 670 of the defrosting controller 600.

According to an embodiment, the defrosting control unit 670 may include a data receiving unit for preprocessing image data and sensor data. One embodiment using the server 700 may further include edge 500 serving as a data processing unit in order to overcome limitations in data processing speed and capacity.

The data processing unit may receive operation data collected from various temperature sensors, humidity sensors, and pressure sensors installed in the compressor, condenser, and evaporator of the air conditioner, and connecting pipes, and image data collected by the camera module 355 installed in the outdoor heat exchanger 104, and may proceed with the data preprocessing process. The data processing unit may receive image data collected by the camera module 355 installed in the outdoor heat exchanger 104 in the form of a batch file every set sampling period.

The data processing unit may perform a data preprocessing process according to the input data format of the image classification model of the frosting detection unit 671 through gray scale conversion and pixel size adjustment of the received image data.

The data processing unit may receive operation data of the air conditioner 50 from the sensor unit 350, such as various temperature/humidity sensor and pressure sensor installed in the compressor, condenser, evaporator, and various places in the connection pipes, every set sampling cycle. The data processing unit may perform a data preprocessing process that removes noise by applying a band-pass filter, a low/high-pass filter, for example, to the received operation data, and perform a normalization operation to uniformly adjust the scale for each factor to remove the degree of influence caused by each factor's scale difference, thereby improving prediction performance of the frosting start timing prediction model.

The data processing unit may transmit the image and operation data that completed the data pre-processing process to the frost detector 671 and the frosting start timing predictor 672, respectively. In some cases, the data processing unit may output the frosting and normal image of gray scale into an original image and a modified image to which a data augmentation scheme, such as rotation and brightness change, is applied.

The frost detector 671 may determine whether the air conditioner 50 is frosted in real time or in a set determination cycle using a CNN-based image classification model that reflects various installation environments of the field site where the outdoor unit 20 is actually installed by previously learning the modified image.

The frost detector 671 may receive the preprocessed image data from the data receiving unit as input data and perform a feed-forward operation on the frost detector image classification model to classify whether a corresponding image is a frosted image or a normal image.

An execution trigger of the frost detector 671 starts from a defrosting control logic, and when the procedure for checking the start condition of the defrosting control logic and the procedure for checking the defrosting control cancel condition are performed according to a set cycle, it is possible to diagnose whether the current state of the air conditioner 50 is a frosted state by executing the frost detector 671.

The frost detector 671 determines whether frosting has occurred with respect to a specific number or more instances and obtains a statistically meaningful diagnosis result, uses modes to derive a final determination result for various diagnosis results, and may always set the number of instances used in frosting determination to be an odd number so as to avoid a case in which the frosting determination result is in a tie state.

The frosting start timing predictor 672 may predict the frosting occurrence timing in real time or in a preset prediction cycle using one or more machine learning models, among Random Forest, DNN, and CNN, that previously learned frosting data and normal data obtained by subdividing and labeling the air conditioner operation data at the time of the frosting occurrence by minute until two hours before the frosting occurrence.

The frosting start timing predictor 672 may receive the pre-processed operation data from the data receiving unit as input data and performs a feed-forward operation on the frosting start timing prediction model, and may perform the task of predicting the remaining time until the frosting start timing by minute based on the pattern of a corresponding operation data. The execution trigger of the frosting start timing predictor 672 starts from a frost prevention control logic, and when the procedure for checking the start condition of the frost prevention control logic and the procedure for checking the frost prevention control cancel condition are performed according to a set cycle, it is possible to predict the expected frosting start timing of the air conditioner 50 by executing the frosting start timing predictor 672.

The frosting start timing predictor 672 may predict the frosting start timing for a specific number of instances or more to obtain a statistically meaningful prediction result, and may select an average value of the remaining prediction results excluding maximum and minimum values as a final prediction value of a corresponding frosting start timing calculation cycle. At this time, the mean and standard deviation, which are probability distributions of the prediction results, are calculated, and if the variance value is greater than or equal to a set threshold, it is determined that the final prediction result is not reliable, so that determination is withheld at a corresponding frosting start timing prediction cycle, and the prediction operation may be performed again in the next prediction cycle.

If it is determined that frosting has occurred, the defrosting controller 673 may start a defrosting operation and operate to switch from a heating operation to a cooling operation to defrost the outdoor heat exchanger 104. The error code output unit may receive a defrosting operation mode flag at the timing of starting the defrosting operation to generate an error code, may store the error code in the memory 640, and may output a defrosting operation code on the display of the output unit 635.

The defrosting controller 673 may execute the frost detector 671 every set frosting determination cycle to determine whether the air conditioner 50 is frosted, and cancel the defrosting operation and switch again from the cooling operation to the heating operation when the frost detector 671 determines that it is in a normal state.

When the time remaining time until the predicted frosting starting is within a threshold value, the frost prevention controller 674 may begin the frost prevention operation to prevent the outdoor heat exchanger 104 from frosting. The error code output unit may receive a frost prevention operation mode flag at the timing of starting a frost prevention operation, generate an error code, store the error code in the memory 640, and output the frost prevention operation code on the display of the output unit 635.

The frost prevention control operation is an operation aiming to delay frosting of the outdoor heat exchanger 104 as much as possible by setting the compressor frequency to be lower than the control target frequency during normal operation. The frost prevention controller 674 may execute the prediction of the frosting start timing every set frosting start timing prediction cycle, and cancel the frost prevention operation when the next frosting start timing of the air conditioner 50 is equal to or greater than a set threshold.

If the defrosting operation is in progress, the frost prevention controller 674 holds the execution of the frost prevention control operation, and may hold the check of the condition for starting the frost prevention control if a defrosting operation flag is generated at the time when the frost prevention control is executed. If the defrosting control and the frost prevention control start simultaneously, the defrosting control may have control priority.

When the defrosting operation is canceled by the defrosting controller 673, when the frost prevention operation is canceled by the frost prevention controller 674, the heating operation flag is generated, and the error code output unit receives a corresponding flag to cancel the display of error code of the defrosting operation and frost prevention operation.

Figure 10:
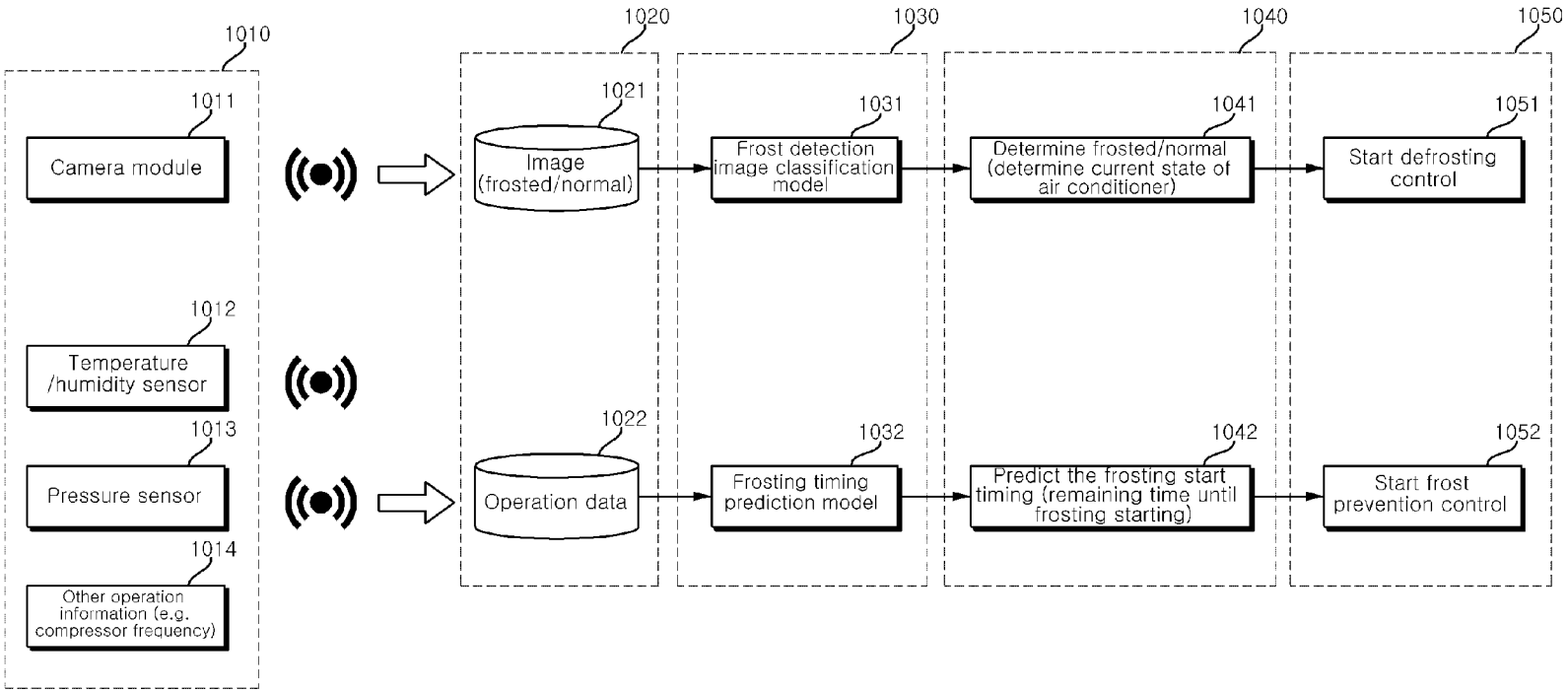
FIG. 10 is a diagram referred to for explaining an operation of an air conditioner system according to an embodiment.

FIG. 10 is a diagram referred to for explaining an operation of an air conditioner system according to an embodiment. The air conditioner system according to an embodiment may obtain data for defrosting control through a detector 1010 disposed in the air conditioner 50. For example, a camera module 1011 installed in the outdoor heat exchanger 104 side may photograph the outdoor heat exchanger 104 to obtain image data, a temperature/humidity sensor 1012 of the sensor unit 350 may obtain temperature/humidity data, a pressure sensor 1013 may obtain pressure data, and other sensors 1014 may obtain other operation information such as a compressor frequency.

In the air conditioner system according to an embodiment, the defrosting control unit 670 may determine whether the air conditioner 50 is frosted and may perform a frosting timing prediction 1040. For example, the frost detector 671 may determine 1041 whether the outdoor heat exchanger 104 is frosted based on image data of the outdoor heat exchanger 104 photographed by the camera module 355. In addition, the frosting start timing predictor 672 may predict 1042 the frosting timing based on sensor data detected by a plurality of sensors of the sensor unit 350.

The defrosting control unit 670 may receive data 1020 obtained from the detector 1010 of the air conditioner 50. The defrosting control unit 670 may store the data in internal memory 640 or external memory 340, 730. Image data 1021 for determining a frosted/normal state and operation data 1022 for determining frosting starting timing may be separately stored.

In addition, the defrosting control unit 670 or the edge 500 may receive data 1020 transmitted as an input value to each machine learning model from the sensor 1010 attached to various components of the air conditioner 50, and may perform preprocessing for each machine learning model.

The camera module 1011 installed in the outdoor unit heat exchanger 104 may photograph an image of the heat exchanger 104 every set sampling cycle so as to directly observe the frosting phenomenon occurring in the heat exchanger 104 in winter, and then transmit the photographed image of the heat exchanger 104 to the data receiving unit in the form of a batch file. The received image data may be processed according to the input data format of the CNN-based frost detection image classification model. The color channel (RGB channel) is converted to gray scale, and three color channels are also resized to one channel. In addition, the pixel size is readjusted to fit the CNN structure of the frost detection image classification model. When the preprocessing process of the input batch image file is finished, it may be transmitted as input data of a frost detection image classification model 1031 as shown in FIG. 10.

Unlike the frost detection image classification model 1031, a frosting timing prediction model 1032 predicts the upcoming frosting timing based on operation data 1022 collected from the sensors 1012, 1013, 1014 installed in each component of the air conditioner 50. The operation data 1022 of the air conditioner 50 is transmitted to the data receiving unit every set sampling cycle. The data receiving unit removes noise with respect to data received from various sensors by applying a filter for signal processing, such as a band-pass filter and a low/high-pass filter, and then exclude inevitable noise generated in various environments where the air conditioner 50 is installed, thereby helping the frosting timing prediction model 1032 analyze a clearer pattern in the given operation data. In addition, the scale for each factor is adjusted to be uniform, for example, between 0 and 1, by performing a normalization operation on each sensor data to remove a degree of influence caused by each factor's scale difference, thereby improving prediction performance of the frosting start timing prediction model.

As the operation data 1022 coming from the sensors 1012, 1013, and 1014 have different units and ranges for each factor, it is necessary to normalize them to a certain range. For example, if the unit of a pressure gauge, such as a condensing pressure and evaporation pressure is kPa and the range is an integer type with three to four digits, a discharge temperature of the compressor uses the unit of ° C. and the range may be a real type between two and three digits. If the factors having different ranges are not normalized, a cost function is distorted due to different scales, and in some cases, the learning of machine learning model may not be performed efficiently, for example, the learning speed may be slow, and it may fall into a local minima. The Min-max Normalization formula commonly used for normalization is as follows.

$$X_{norm} = \frac{(X - X_{min})(b - a)}{(X_{max} - X_{min})} + a, \text{ where: } a \le X_{norm} \le b, \quad \text{[Equation 1]}$$

$X_{norm}$: Normalized input data
$X_{max}$: Maximum input data
$X_{min}$: Minimum input data
(a, b): Normalization range (ex. 0~1)

If the input data is deviated from the minimum and maximum values of the existing learning data, the input data is automatically adjusted to the minimum/maximum value of the existing learning data because it may be deviated from the normalization range when the minimum-maximum normalization is applied, which follows below formula.

$$\text{If } X > X_{max}, X_{norm} = b$$

$$\text{If } X < X_{min}, X_{norm} = a \quad \text{[Equation 2]}$$

The operation data that completed the noise removal and normalization process are transmitted to the frosting start timing predictor.

The data preprocessing process performed by the data receiving unit is mainly performed at the edge 500 in the air conditioner system configured with edge computing as shown in FIG. 5, and when the preprocessing process for sensor data is completed at the edge 500, corresponding data is transferred to cloud server 700 and a machine learning model calculation necessary for detection of frosting and prediction of frosting timing is achieved. Such edge computing is effective if it is introduced when there are many types of sensor data mainly handled and when the expected data load on the cloud server 700 is large.

In the air conditioner system in which AI computing is implemented with a cloud computing structure as shown in FIG. 4, all control logic from the data reception to the detection and prediction of frosting is performed in the cloud server 700. When applying the machine learning models requiring high-performance calculation as shown in FIG. 4 to an existing air conditioner, there is an advantage in that resources of the cloud server 700 may be utilized even if only a communication module is separately constructed.

In the case of FIGS. 4 and 5, most of the calculations are performed in the cloud server 700 or the edge 500, but if the air conditioner 500 contains defrosting control unit 670 having a strong calculation performance, defrosting control may be established in an embedded type, so that all processes from data reception to pre-processing, machine learning model calculation, and prediction result derivation can be implemented using resources inside a controller.

According to an embodiment, each component is modularized as shown in FIG. 6, and each module is configured to operate when only input/output data is exchanged therebetween. Therefore, there is an advantage that it can be applied to configuration of all air conditioner system from edge computing to an embedded system of the air conditioner.

The defrosting control unit 670 may process (1030) data 1020 according to each machine learning model. The frost detector 671 may receive image data 1021 as input data and perform a feed-forward operation on the frost detection image classification model 1031 to classify whether a corresponding image is in a frosted state image or a normal state image. The frosting start timing predictor 672 may receive the operation data 1022 as input data to perform a feed-forward operation on the frosting start point prediction model 1032 and predict the remaining time until the frosting start timing by minute, based on the pattern of corresponding operating data.

The air conditioner 50 may perform an operation based on the determination/prediction of the defrosting control unit 670 (1051). When the outdoor heat exchanger 104 is determined to be in a frosted state, the defrosting controller 673 may control to perform a defrosting operation by starting the defrosting control (1051). When the remaining time until the frosting predicted by the frost start timing predictor 672 is less than or equal to a threshold value, the frost prevention controller 674 may control to start the frost prevention control (1052) to perform the frost prevention operation.

Figure 11:
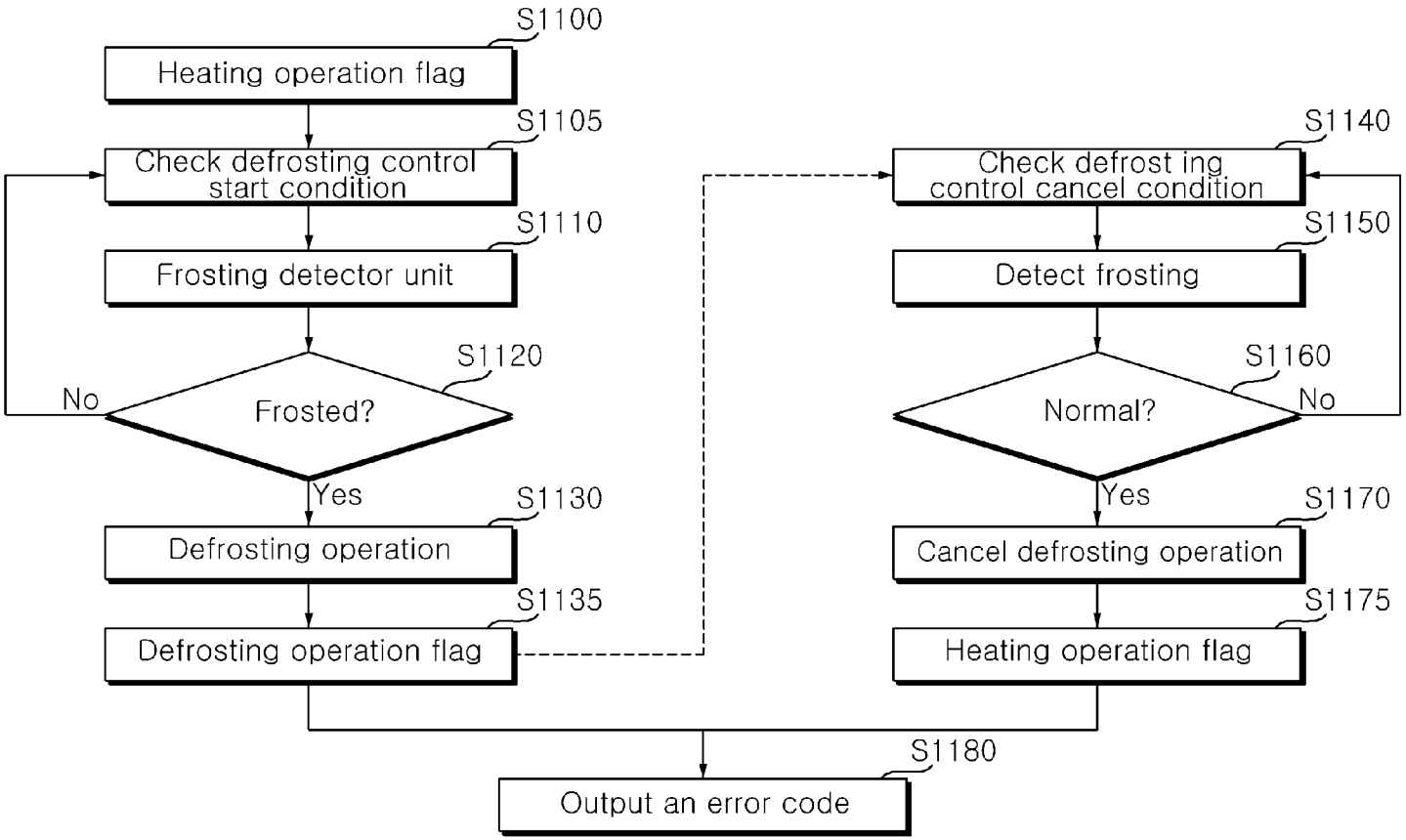
FIG. 11 is a flowchart of a method for operating an air conditioner system according to an embodiment.

FIG. 11 is a flowchart of a method for operating an air conditioner system according to an embodiment, and illustrates defrosting control logic. The defrosting controller 673 may include a defrosting control start condition check unit and a defrosting control cancel condition check unit.

Referring to FIG. 11, during the heating operation (S1100), the defrosting control start condition check unit checks the defrosting control start condition (S1105). The defrosting control start condition check unit calls the frost detector 671 every set frosting determination cycle (S1110), and determines whether the air conditioner 50 is frosted (S1120).

At this time, if the frost detector 671 determines that the current state of the air conditioner is a frosted state (S1120), the defrosting operation starts (S1130), and if it is determined that it is not a frosted state (S1120), the frosting detector 671 is called again in the next calculation cycle to progress a process (S1120) of determining whether it is a frosted state. The defrosting controller 673 operates during the heating operation (S1100), and the defrosting control does not operate during the cooling operation.

When the frost detector 671 determines that it is a frosted state, the defrosting controller 673 switches the operation mode from heating to defrosting, and when switching to a defrosting operation, it operates to switch from heating operation to cooling operation so as to remove the frost from the heat exchanger in the outdoor unit side (S1130). As the operation mode is changed to a defrost mode, a defrosting operation flag S1135 is generated and transmitted to an error code output unit (S1180).

When the operation mode is the defrosting mode, the defrosting control cancel condition check unit operates (S1140), and the defrosting control cancel condition check unit calls the frost detector 671 every set cycle to check whether the state of the air conditioner 50 is changed from a frosted state to a normal state. (S1160).

If the frost detector 671 determines that it is still a frosted state (S1160), the frost detector 671 is called again in the next calculation cycle and it is determined again whether the air conditioner 50 has returned to the normal state (S1160). If the state of the air conditioner 50 returns to a normal state from the frosted state (S1160), the defrosting controller 673 cancels the defrosting operation (S1170), and switches the operation mode from cooling to heating again. At this time, a heating operation flag is generated (S1175), and transmitted to the error code output unit (S1175). When the defrosting control starts, the defrosting control obtains control priority, so if the frost prevention control and the defrosting control start simultaneously, the defrosting control is executed first. If the defrosting control is in progress, the frost prevention controller 674 holds execution until the cancel of defrosting control.

Figure 12:
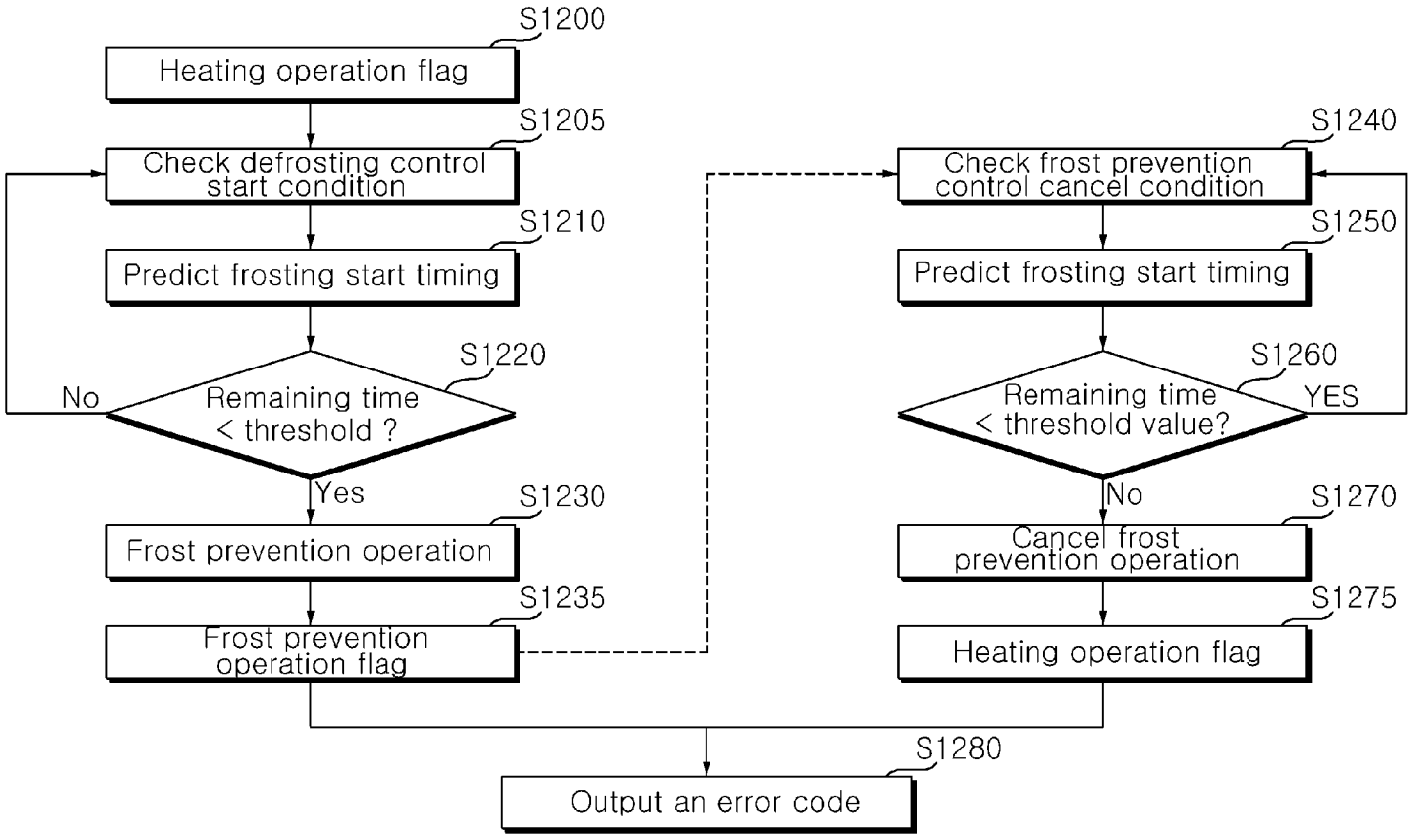
FIG. 12 is a flowchart of a method for operating an air conditioner system according to an embodiment.

FIG. 12 is a flow chart of a method for operating an air conditioner system according to an embodiment, and illustrates a control logic for preventing frost. The frost prevention controller 674 may include a frost prevention control start condition check unit and a frost prevention control cancel condition check unit.

Referring to FIG. 12, during a heating operation (S1200), the frost prevention control start condition check unit checks a defrosting control start condition (S1205). The frost prevention control start condition check unit calls the frosting start timing predictor 672 every set frosting determination cycle, and predicts the remaining time until the next frosting of the air conditioner 50 by minute (S1210). At this time, if the remaining time until the next frosting timing predicted by the frosting start timing predictor 672 is less than the set threshold (S1220), the frost prevention operation starts (S1230), and in the opposite case (S1220), the process of predicting the frosting timing by calling the frosting start timing predictor 672 again in the next prediction cycle is repeated (S1210).

Like the defrosting controller 673, the frost prevention controller 674 operates during the heating operation, and the frost prevention control does not operate during the cooling operation. In addition, when the defrosting operation flag is generated at the execution timing of the frost prevention controller 674, the execution of the frost prevention control start condition check unit is hold.

The frost prevention control operation aims to delaying frosting of the heat exchanger in the outdoor unit side as much as possible by deliberately lowering the outdoor heat exchange rate by setting the compressor frequency to be lower than a control target frequency in normal operation by a predefined value, for example, operating at 95% of the existing target frequency. At this time, the frost prevention operation flag is generated (S1235), and transmitted to the error code output unit (S1280).

When the frost prevention operation flag is generated, the frost prevention control cancel condition check unit is operated (S1240), and the frosting start timing predictor 672 is called every set period (S1250), and it is checked whether the remaining time until the next frosting is lower than the threshold value (S1260). For example, a corresponding threshold value may be derived experimentally by measuring the average time for frosting by repeatedly executing an experiment of inducing frosting occurrence from when the operating cycle of the air conditioner 50 enters a normal state in a special chamber in which indoor and outdoor temperature conditions and humidity are set to generate the defrosting operation condition. Alternatively, the threshold value may be derived by learning the frosting occurrence timing and operation data using a machine learning model.

When the value predicted by the frosting start timing predictor 672 is less than the threshold value (S1260), the frosting start timing predictor 672 is called again in the next prediction cycle to check whether the frosting of the air conditioner 50 is imminent. When the occurrence timing of the next frosting of the air conditioner 50 is later than the threshold value (S1260), the frost prevention operation is canceled (S1270), and the operation mode is switched to the normal heating operation. At this time, a heating operation flag is generated (S1275), and is transmitted to the error code output unit (S1280).

The error code output unit serves to output and notify an error code so as to inform a user and maintenance service engineer of the current state of the product when the defrosting control or frost prevention control is initiated. The error code output unit may prevent the defrosting operation error code or the frost prevention operation error code from being displayed any more immediately upon receiving the heating flag.

After receiving the preprocessed image data, the frost detector 671 uses the received image data as input data of the CNN-based frost detection image classification model 1031 to directly perform a feed forward operation. Through this, the received input data image is classified whether it is a normal image or a frosted image.

The determination of the frosting through such a direct observation has a significant advantage in comparison with conventional rule-based frost determination logic. In the case of the rule-based frost determination logic, it detects the physical phenomena on the heating cycle that is changed after frosting occurs in the outdoor heat exchanger 104, and makes this into a threshold-based rule to determine the presence or absence of frost. Accordingly, there is a disadvantage in that it is possible to determine the frosting only after a clear difference in the heating cycle pattern has occurred after a considerable amount of time has passed since the actual frosting phenomenon occurred. Due to this, there is a problem in that the frosting logic operates after the heat exchange efficiency has already deteriorated considerably due to the defrosting operation, and as the frosting has already progressed to a great extent, it takes a long time to remove the frost. In addition, as the logic itself is based on rules, there is a problem in that accuracy of the frosting determination logic is low because the logic cannot determine frosting even if an actual frosting occurs unless it exceeds the threshold value for determining frosting.

In comparison with the conventional technology, embodiments disclosed herein diagnose the defrosting operation through direct observation using the camera module 355 and the frost detection image classification model 1051. Accordingly, there is an advantage in that it is possible to quickly and accurately determine the frosting when frosting occurs in the heat exchanger 104. It has an advantage of being able to easily detect the initial frosting, which is difficult to detect in the existing rule-based frosting logic, using the CNN structure having verified image classification performance.

In the case of the image classification model 1031 used in the frost detector 671, as shown in FIG. 9, it follows the conventional CNN structure, and extracts patterns (features) of the image through convolutional layers, followed by a pooling layer to reduce a dimension of the image to reduce computational speed and memory usage and reduce the number of parameters, thereby avoiding overfitting. This is a structure in which the combination of the convolutional layer and the pooling layer is repeated, and finally passes through the fully-connected layers and ends with two output nodes (normal/frosting). At this time, Rectified Linear Unit (ReLU) is mainly used as an activation function of each convolutional layer, and a softmax activation function and a cross-entropy cost function are used in the last fully connected layer.

The frost detector 671 performs the frosting determination according to the frosting determination cycle set in the defrosting control logic when an execution command is given by the start condition check logic and defrosting control cancel logic of the defrosting controller 673.

When determining frosting, a specific number of instances or more is defined as a batch size, and it is determined whether frosting has occurred with respect to this, thereby securing a statistically meaningful diagnosis result. As the final output result of the frost detection image classification model is frosted or normal, the final classification result for a corresponding batch is determined using a mode. At this time, in order to avoid a case in which the frosting determination result is in a tie state, the batch size used in frosting determination is always set to be an odd number.

The frosting start timing predictor 672 receives cycle operation data from the data collection unit as input data, performs a feed-forward operation on one or more machine learning models among Random Forest, Deep Neural Network (DNN), and CNN, and predicts the remaining time until the next frosting starting by minute.

Figure 13:
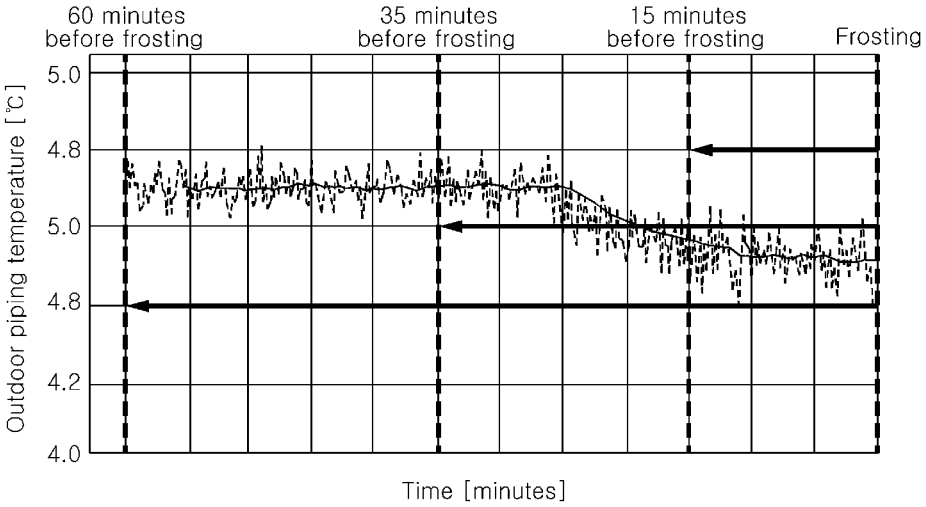
FIG. 13 is a diagram referred to for explaining a method for operating an air conditioner system according to an embodiment.

FIG. 13 is a diagram referred to for explaining a method for operating an air conditioner system according to an embodiment, and is an example showing the principle of such a prediction model. When the prediction model learned the pattern of frosting data shown in FIG. 13 and receives the outdoor unit piping temperature as an input factor, it predicts how many minutes remain from the frosting timing.

The frosting start timing predictor 672 predicts the remaining time until the next frosting starting according to the frosting start timing prediction cycle set in the frost prevention control logic when an execution command is given from the start condition check logic and the frost prevention control cancel logic of the frost prevention controller 674.

When determining the frosting start timing, a specific number of instances or more is defined as a batch size, and the frosting start timing for this is predicted to obtain a statistically significant prediction result. The average value is used to derive the final prediction result, and in order to derive a more conservative average value, the average value of the remaining prediction results excluding the maximum and minimum values of the prediction value is selected as the final prediction value of a corresponding frosting start timing calculation cycle. Before transmitting the final prediction value to the frost prevention controller 674, the probability distribution of the prediction values is verified once more by calculating the mean and standard deviation which are a probability distribution of prediction results used to derive the frosting start timing prediction value. If the variance value is greater than or equal to the set threshold value, it can be considered that the prediction model excessively reflects the noise inherent in the data. Therefore, it is determined that the final prediction result is not reliable, the determination is held in the prediction cycle of corresponding frosting start timing, and the next frosting timing prediction is attempted again in the next prediction cycle.

According to embodiments disclosed herein, it is possible to quickly and accurately determine whether a heat exchanger is frosted based on an image not on a prediction, and appropriately perform a defrosting operation to improve heat exchange and heating efficiency. In addition, according to embodiments disclosed herein, by predicting the frosting start timing, it is possible to enhance efficiency of the heating operation by reducing the number of defrosting operation starts and frosting of the heat exchanger.

The air conditioner system and method for operating an air conditioner system according to embodiments are not limited to the configuration and method of embodiments described above, but all or some of the embodiments may be selectively combined and configured so that various modifications may be achieved.

According to embodiments disclosed herein, it is possible to accurately determine whether a heat exchanger is frosted. In addition, according to embodiments disclosed herein, it is possible to improve heat exchange and heating efficiency by appropriately performing a defrosting operation.

Further, according to embodiments disclosed herein, by predicting the frosting start timing, it is possible to enhance efficiency of the heating operation by reducing the number of the defrosting operation starts. Furthermore, according to embodiments disclosed herein, by predicting the frosting start timing, it is possible to enhance efficiency of the heating operation by reducing frosting of the heat exchanger.

Meanwhile, other various advantages will be directly or implicitly disclosed in the description according to embodiments described herein.

Embodiments disclosed herein have been made in view of the above problems, and provide an air conditioner system capable of accurately determining whether a heat exchanger is frosted, and a method for operating an air conditioner system. Embodiments disclosed herein further provide an air conditioner system capable of improving heat exchange and heating efficiency by appropriately performing a defrosting operation, and a method for operating an air conditioner system.

Embodiments disclosed herein further provide an air conditioner system capable of increasing efficiency of a heating operation by reducing the number of starts of a defrosting operation by predicting the timing of starting frosting, and a method for operating an air conditioner system. Embodiments disclosed herein further provide an air conditioner system capable of increasing efficiency of a heating operation by reducing frosting of a heat exchanger by predicting a frosting start timing, and a method for operating an air conditioner system.

In order to achieve the above or other advantages, an air conditioner system and a method for operating an air conditioner system according to embodiments disclosed herein determine whether frosting has occurred based on image data of an outdoor heat exchanger, and predict a frosting timing based on sensor data detected by sensors, thereby accurately determining whether frosting has occurred and preventing frosting.

In accordance with embodiments disclosed herein, an air conditioner may include a compressor, an outdoor heat exchanger configured to perform heat exchange using refrigerant discharged from the compressor, a camera module configured to photograph the outdoor heat exchanger, a sensor unit which has a plurality of sensors, and a communication unit configured to transmit an image of the outdoor heat exchanger photographed by the camera module and sensor data detected by the sensor unit, and a server comprising a communication unit configured to receive the image of the outdoor heat exchanger photographed by the camera module and the sensor data detected by the sensor unit, and a defrosting controller configured to determine whether the outdoor heat exchanger is frosted based on the image data of the outdoor heat exchanger photographed by the camera module, and predict a frosting timing based on the sensor data detected by the sensor unit.

The defrosting controller may include a frost detector configured to classify the image data of the outdoor heat exchanger into image data of frosting and normal states, using a Convolutional Neural Network (CNN)-based image classification model, and a frosting start timing prediction unit (predictor) configured to predict a remaining time until frosting, using one or more machine learning models, when cycle operation data of the air conditioner is input.

The defrosting controller may further include a defrosting controller configured to control the air conditioner to perform a defrosting operation when the frost detector determines a frosted state, and a frost prevention controller configured to control performing a frost prevention operation, when the remaining time until frosting predicted by the frosting start timing prediction unit is less than or equal to a threshold value.

In addition, in the defrosting operation, when the air conditioner is in a heating operation, the air conditioner may be switched to a cooling operation to operate until the frost detector determines a normal state. In the frost prevention operation, the compressor may be driven at an operating frequency lower than an operating frequency of the compressor at a normal state.

The communication unit of the server may transmit a control signal output from the defrost controller or the frost prevention controller to the air conditioner. The air conditioner may perform the defrosting operation or the frost prevention operation based on a control signal received from the server.

The defrosting controller may include an error code output unit configured to generate a corresponding error code, when the defrosting operation or the frost prevention operation is performed, and a memory configured to store the error code. The defrosting controller may further include a data receiving unit configured to convert a pixel size and gray scale of the image data of the outdoor heat exchanger. The data receiving unit may receive the sensor data from the sensor unit every set sampling cycle, and remove noise.

The air conditioner system in accordance with embodiments disclosed herein may further include an edge configured to convert a pixel size and gray scale of the image data of the outdoor heat exchanger. The edge may receive the sensor data from the sensor unit every set sampling cycle, and remove noise.

In accordance with embodiments disclosed herein, an air conditioner system is provided that may include a compressor; an outdoor heat exchanger configured to perform heat exchange using refrigerant discharged from the compressor; a camera module configured to photograph the outdoor heat exchanger; a sensor unit including a plurality of sensors; and a controller configured to perform a defrosting operation by determining whether the outdoor heat exchanger is frosted based on an image of the outdoor heat exchanger photographed by the camera module, and perform a frost prevention operation by predicting a frosting timing based on sensor data detected by the sensor unit. The controller may include a frost detector configured to classify image data of the outdoor heat exchanger into image data of frosting and normal states, using a Convolutional Neural Network (CNN)-based image classification model, and a frosting start timing prediction unit (predictor) configured to predict a remaining time until frosting, using one or more machine learning models, when cycle operation data of the air conditioner is input.

In addition, the controller may include a defrosting controller configured to control the air conditioner to perform a defrosting operation when the frost detector determines a frosted state, and a frost prevention controller configured to control preforming a frost prevention operation, when the remaining time until frosting predicted by the frosting start timing prediction unit is less than or equal to a threshold value.

The air conditioner system in accordance with embodiments disclosed herein may further include a display unit (display) configured to display a corresponding error code, when the defrosting operation or the frost prevention operation is performed, and a memory configured to store the error code.

In the defrosting operation, when the air conditioner is in a heating operation, the air conditioner may be switched to a cooling operation to operate until the frost detector determines as a normal state. In the frost prevention operation, the compressor may be driven at an operating frequency lower than an operating frequency of the compressor in a normal state.

The controller may further include a data receiving unit configured to convert a pixel size and gray scale of image data of the outdoor heat exchanger, and remove noise of the sensor data.

In accordance with embodiments disclosed herein, a method for operating an air conditioner system is provided that may include determining whether an outdoor heat exchanger is frosted based on image data of the outdoor heat exchanger photographed by a camera module; performing a defrosting operation when the outdoor heat exchanger is determined to be in a frosted state; predicting a frosting timing based on sensor data detected by a plurality of sensors; and performing a frost prevention operation when a remaining time until frosting predicted by a frosting start timing prediction unit is less than or equal to a threshold value.

Determining whether an outdoor heat exchanger is frosted may include classifying image data of the outdoor heat exchanger into image data of frosted and normal states, using a Convolutional Neural Network (CNN)-based image classification model, and predicting a frosting timing includes predicting a remaining time until frosting, using one or more machine learning models, when cycle operation data of the air conditioner is input.

The method for operating an air conditioner system in accordance with embodiments disclosed herein may further include generating a corresponding error code when the defrosting operation or the frost prevention operation is performed, and storing the error code. In the defrosting operation, when the air conditioner is in a heating operation, the air conditioner may be switched to a cooling operation to operate until the frost detector determines a normal state, and in the frost prevention operation, the compressor may be driven at an operating frequency lower than an operating frequency of the compressor in a normal state.

The method for operating an air conditioner system in accordance with embodiments disclosed herein may further include converting a pixel size and gray scale of the image data of the outdoor heat exchanger, and removing noise of the sensor data.

While embodiments have been particularly shown and described with reference to exemplary embodiments thereof, it will be understood by those of ordinary skill in the art that various changes in form and detail may be made herein without departing from the spirit and scope as defined by the claims and such modifications and variations should not be understood individually from the technical idea or aspect.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer, or section from another region, layer, or section. Thus, a first element, component, region, layer, or section could be termed a second element, component, region, layer, or section without departing from the teachings of the present invention.

Spatially relative terms, such as "lower", "upper" for example, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings, and the appended claims. In addition to variations and modifications in the component parts and/or arrangements, alternative uses will also be apparent to those skilled in the art.

What is claimed is:

1. An air conditioner system, comprising:

an air conditioner comprising a compressor, an outdoor heat exchanger configured to perform heat exchange using a refrigerant discharged from the compressor, a camera module configured to photograph the outdoor heat exchanger, a sensor unit comprising a plurality of sensors, and a communication unit configured to transmit an image of the outdoor heat exchanger photographed by the camera module and sensor data detected by the sensor unit; and a server comprising a server communication unit configured to receive the image of the outdoor heat exchanger photographed by the camera module and the sensor data detected by the sensor unit, and a defrosting control device configured to determine whether the outdoor heat exchanger is frosted based on the image data of the outdoor heat exchanger photographed by the camera module, and predict a frosting timing based on the sensor data detected by the sensor unit, wherein the defrosting control device comprises:

a frost detector configured to classify the image data of the outdoor heat exchanger into image data of frosted and normal states, using a Convolutional Neural Network (CNN)-based image classification model;

a frosting start timing predictor configured to predict a remaining time until frosting, using one or more machine learning models, when cycle operation data of the air conditioner is input;

a defrosting controller configured to control the air conditioner to perform a defrosting operation when the frost detector determines a frosted state; and a frost prevention controller configured to control performing a frost prevention operation, when the remaining time until frosting predicted by the frosting start timing predictor is less than or equal to a threshold value, wherein the frosting start timing predictor predicts a corresponding frosting timing and predicts the remaining time until frosting using a frosting start point prediction model, when receiving cycle operation data obtained from the sensor unit, and wherein the frosting start point prediction model received the cycle operation data detected by the sensor unit as input data and predict the remaining time until the frosting start timing, based on a pattern of corresponding operating data.

2. The air conditioner system of claim 1, wherein in the defrosting operation, when the air conditioner is in a heating operation, the air conditioner is switched to a cooling operation to operate until the frost detector determines a normal state, and in the frost prevention operation, the compressor is driven at an operating frequency lower than an operating frequency of the compressor in a normal state.

3. The air conditioner system of claim 1, wherein the server communication unit of the server transmits a control signal output from the defrosting controller or the frost prevention controller to the air conditioner, and the air conditioner performs the defrosting operation or the frost prevention operation based on the control signal received from the server.

4. The air conditioner system of claim 1, wherein the defrosting control device further includes a data receiving unit configured to convert a pixel size and gray scale of the image data of the outdoor heat exchanger.

5. The air conditioner system of claim 4, wherein the data receiving unit receives the sensor data from the sensor unit every set sampling cycle, and removes noise.

6. The air conditioner system of claim 1, further comprising an edge configured to convert a pixel size and gray scale of the image data of the outdoor heat exchanger.

7. The air conditioner system of claim 6, wherein the edge receives the sensor data from the sensor unit every set sampling cycle, and removes noise.

8. An air conditioner system, comprising:

a compressor;

an outdoor heat exchanger configured to perform heat exchange using refrigerant discharged from the compressor;

a camera module configured to photograph the outdoor heat exchanger;

a sensor unit including a plurality of sensors; and a controller configured to perform a defrosting operation by determining whether the outdoor heat exchanger is frosted based on an image of the outdoor heat exchanger photographed by the camera module, and perform a frost prevention operation by predicting a frosting timing based on sensor data detected by the sensor unit, wherein the controller comprises:

a frost detector configured to classify image data of the outdoor heat exchanger into image data of frosted and normal states, using a Convolutional Neural Network (CNN)-based image classification model;

a frosting start timing predictor configured to predict a remaining time until frosting, using one or more machine learning models, when cycle operation data of the air conditioner is input;

a defrosting controller configured to control the air conditioner to perform a defrosting operation when the frost detector determines a frosted state; and a frost prevention controller configured to control the air conditioner to perform a frost prevention operation, when the remaining time until frosting predicted by the frosting start timing predictor is less than or equal to a threshold value, wherein the frosting start timing predictor predicts a corresponding frosting timing and predicts the remaining time until frosting using a frosting start point prediction model, when receiving cycle operation data obtained from the sensor unit, and wherein the frosting start point prediction model received the cycle operation data detected by the sensor unit as input data and predict the remaining time until the frosting start timing, based on a pattern of corresponding operating data.

9. The air conditioner system of claim 8, wherein in the defrosting operation, when the air conditioner is in a heating operation, the air conditioner is switched to a cooling operation to operate until the frost detector determines a normal state, and in the frost prevention operation, the compressor is driven at an operating frequency lower than an operating frequency of the compressor in a normal state.

10. The air conditioner system of claim 8, wherein the controller further comprises a data receiving unit configured to convert a pixel size and gray scale of image data of the outdoor heat exchanger, and remove noise of the sensor data.

* * * * *